US009117461B2

(12) United States Patent
Ishikawa et al.

(10) Patent No.: US 9,117,461 B2
(45) Date of Patent: Aug. 25, 2015

(54) CODING DEVICE, DECODING DEVICE, CODING METHOD, AND DECODING METHOD FOR AUDIO SIGNALS

(75) Inventors: Tomokazu Ishikawa, Osaka (JP); Takeshi Norimatsu, Hyogo (JP); Haishan Zhong, Singapore (SG); Dan Zhao, Singapore (SG); Kok Seng Chong, Singapore (SG)

(73) Assignee: PANASONIC CORPORATION, Osaka (JP)

( * ) Notice: Subject to any disclaimer, the term of this patent is extended or adjusted under 35 U.S.C. 154(b) by 246 days.

(21) Appl. No.: 13/816,741

(22) PCT Filed: Oct. 5, 2011

(86) PCT No.: PCT/JP2011/005615

§ 371 (c)(1), (2), (4) Date: Feb. 13, 2013

(87) PCT Pub. No.: WO2012/046447

PCT Pub. Date: Apr. 12, 2012

(65) Prior Publication Data

US 2013/0144611 A1 Jun. 6, 2013

(30) Foreign Application Priority Data

Oct. 6, 2010 (JP) ..... 2010-226681

(51) Int. Cl.
*G10L 19/26* (2013.01)
*G10L 25/90* (2013.01)
(Continued)

(52) U.S. Cl.
CPC ..... *G10L 25/90* (2013.01); *G10L 19/26* (2013.01); *G10L 19/0212* (2013.01); *G10L 19/09* (2013.01); *G10L 19/265* (2013.01); *G10L 2025/906* (2013.01)

(58) Field of Classification Search
None
See application file for complete search history.

(56) References Cited

U.S. PATENT DOCUMENTS 5,285,498 A 2/1994 Johnston
5,481,614 A 1/1996 Johnston
(Continued)

FOREIGN PATENT DOCUMENTS

EP 2 107 556 10/2009
JP 05-108085 4/1993
(Continued)

OTHER PUBLICATIONS

European Search Report issued Oct. 23, 2014 for the corresponding European Patent Application No. 11830381.7.
(Continued)

*Primary Examiner* — Jeremiah Bryar
(74) *Attorney, Agent, or Firm* — Wenderoth, Lind & Ponack, L.L.P.

(57) ABSTRACT

A coding device includes: a pitch contour detection unit which detects a pitch contour of an input audio signal; a dynamic time warping unit which determines the number of pitch nodes based on the pitch contour and generates a first time warping parameter including information indicating the determined number of pitch nodes, a pitch change position, and a pitch change ratio; a first encoder which codes the first time warping parameter; a time warping unit which corrects pitch, using the information obtained from the first time warping parameter, to approximate the pitches of the number of pitch nodes to a predetermined reference value; a second encoder which codes the input audio signal at the corrected pitch; and a multiplexer which multiplexes the coded time warping parameter and the coded audio signal to generate a bitstream.

12 Claims, 17 Drawing Sheets

(51) Int. Cl.
*G10L 19/09* (2013.01)
*G10L 19/02* (2013.01)

(56) References Cited

U.S. PATENT DOCUMENTS

| | | | | |
|---|---|---|---|---|
| 7,788,105 | B2 | 8/2010 | Miseki | |
| 7,825,321 | B2 | 11/2010 | Bloom et al. | |
| 8,160,871 | B2 | 4/2012 | Miseki | |
| 8,249,866 | B2 | 8/2012 | Miseki | |
| 8,260,621 | B2 | 9/2012 | Miseki | |
| 8,296,131 | B2 * | 10/2012 | Shallom et al. | 704/200.1 |
| 8,315,861 | B2 | 11/2012 | Miseki | |
| 8,700,388 | B2 * | 4/2014 | Edler et al. | 704/207 |
| 2006/0020450 | A1 | 1/2006 | Miseki | |
| 2006/0165240 | A1 | 7/2006 | Bloom et al. | |
| 2007/0100607 | A1 | 5/2007 | Villemoes | |
| 2008/0004869 | A1 | 1/2008 | Herre et al. | |
| 2010/0017198 | A1 | 1/2010 | Yamanashi et al. | |
| 2010/0198586 | A1 * | 8/2010 | Edler et al. | 704/203 |
| 2010/0250245 | A1 | 9/2010 | Miseki | |
| 2010/0250262 | A1 | 9/2010 | Miseki | |
| 2010/0250263 | A1 | 9/2010 | Miseki | |
| 2012/0173230 | A1 | 7/2012 | Miseki | |
| 2013/0144611 | A1 * | 6/2013 | Ishikawa et al. | 704/207 |

FOREIGN PATENT DOCUMENTS

| | | |
|---|---|---|
| JP | 06-075590 | 3/1994 |
| JP | 2002-268694 | 9/2002 |
| JP | 2005-258226 | 9/2005 |
| JP | 2008-529078 | 7/2008 |
| JP | 2008-262140 | 10/2008 |
| WO | 2006/079813 | 8/2006 |
| WO | 2008/072737 | 6/2008 |

OTHER PUBLICATIONS

International Search Report issued Dec. 20, 2011 in International (PCT) Application No. PCT/JP2011/005615.

Bernd Edler et al., "A Time-warped MDCT Approach to Speech Transform Coding", 126th AES Convention, Munich, Germany, May 2009.

Milan Jelínek et al., "Wideband Speech Coding Advances in VMR-WB Standard", IEEE Transactions on Audio, Speech, and Language Processing, vol. 15, No. 4, May 2007.

Xuejing Sun, "Pitch Determination and Voice Quality Analysis Using Subharmonic-to-Harmonic Ratio", 2002 IEEE International Conference on Acoustics, Speech, and Signal Processing (ICASSP), May 2002, p. I-333-I-336.

* cited by examiner

CODING DEVICE, DECODING DEVICE, CODING METHOD, AND DECODING METHOD FOR AUDIO SIGNALS

TECHNICAL FIELD

The present invention relates to coding devices, decoding devices, coding methods, and decoding methods for coding inputted audio signals or decoding the coded audio signals.

BACKGROUND ART

A coding device is designed to code an audio signal efficiently. In human speech, the fundamental frequency (pitch) of an audio signal changes sometimes. This causes the energy of the audio signal to propagate through wider frequency bands. It is not efficient to code a pitch-changing audio signal by an acoustic signal coding device, especially in a low bit-rate.

Therefore, conventionally, the time warping technology is used to compensate the effect of pitch change (See Patent Literature (PTL) 1and Non Patent Literature (NPL) 1, for example).

More specifically, the time warping technology is used to achieve pitch correction (pitch shifting). FIGS. 1A and 1B illustrate an example of the conventional scheme of pitch shifting. Specifically, FIG. 1A shows a spectrum of an audio signal before pitch shifting, and FIG. 1B shows a spectrum of the audio signal after pitch shifting.

As shown in the drawings, the pitches are shifted from 200 Hz in FIG. 1A to 100 Hz in FIG. 1B. In this manner, by shifting the pitches of the next frame to align with the pitches of a previous frame, the pitches are made consistent. In this case, the energy of the audio signal converges as shown in FIGS. 2A to 2C.

FIG. 2A shows a sweep signal before pitch shifting in the conventional pitch shifting of audio signals. FIG. 2B shows a sweep signal after pitch shifting in the conventional pitch shifting of audio signals. As shown in the drawings, the pitches of the audio signal become constant by pitch shifting.

Furthermore, FIG. 2C shows the spectrum before and after pitch shifting in the conventional pitch shifting of audio signals. Here, the graph a in FIG. 2C shows the spectrum before pitch shifting and the graph b in FIG. 2C shows the spectrum after pitch shifting. As shown in FIG. 2C, the energy after pitch shifting is confined to a narrow bandwidth.

Here, pitch shifting is achieved using the re-sampling scheme, for example. In order to maintain a consistent pitch, a ratio of re-sampling (hereinafter referred to as a re-sampling rate) varies according to a pitch change ratio. By applying a pitch tracking algorithm to coding of a frame, a pitch contour of this frame can be obtained.

More specifically, the frame is segmented into small sections for pitch tracking. The adjacent sections may be overlapped. As the pitch tracking algorithm, for example, there are a pitch tracking algorithm based on auto-correlation (see NPL 2, for example), and a pitch detection scheme based on a frequency domain (see NPL 3, for example).

Each section has a corresponding pitch value. FIGS. 3 and 4 illustrate a conventional calculation scheme of pitch contours of audio signals. FIG. 3 shows that the pitches change depending on time. Furthermore, as shown in FIG. 4, one pitch value is calculated from one section of the audio signal. The pitch contour is the concatenation of the pitch values.

In pitch shifting, the re-sampling rate is in proportion to the pitch change ratio. Furthermore, information indicating the pitch change ratio is extracted from the pitch contour. Cent and half tone are often used to measure this pitch change ratio. FIG. 5 shows a measurement of the cent and half tone. The cent (c in FIG. 5) is calculated from a pitch ratio (pitch change ratio) of adjacent pitches as shown below.

$$\text{cent} = 1200 \times \log_2 \frac{\text{pitch}(i+1)}{\text{pitch}(i)} \quad \text{[Math 1]}$$

According to the pitch change ratio, re-sampling is applied to the audio signal. Pitches of other sections are shifted to a reference pitch in order to obtain a consistent pitch. For example, if a pitch of the next section is higher than a pitch of the previous section, the re-sampling rate is set to a lower rate in proportion to the cent difference between the two pitches. Furthermore, if the pitch of the next section is lower than the pitch of the previous section, the re-sampling rate is set to a higher rate.

Taking into consideration a recording player capable of adjusting the reproduction speed of audio for a higher tone by lowering the reproduction speed, the tone is shifted to a lower frequency. This is similar to the idea of re-sampling the signal that is in proportion to the pitch change ratio.

FIGS. 6 and 7 illustrate a coding device and a decoding device applied with the time warping scheme. As shown in FIG. 6, the coding device performs transform coding after performing time warping on an input signal, using pitch ratio information. The pitch ratio information is needed in the decoding device which performs reverse time warping shown in FIG. 7.

Therefore, the pitch ratio has to be coded by the coding device. In prior arts, a fixed table corresponding to a small pitch ratio is used to code the pitch ratio information, and efforts are made to improve coding sound quality through time warping processing under a condition that there are limited numbers of bits available for coding the pitch ratio.

CITATION LIST

Patent Literature

[PTL 1] Patent Application Publication No. US20080004869A1

Non Patent Literature

[NPL 1] Bernd Edler, "A Time-warped MDCT Approach To Speech Transform Coding", AES 126th Convention, Munich, Germany, May 2000

[NPL 2] Milan Jelinek, "Wideband Speech Coding Advances in VMR-WB Standard", IEEE Transactions on Audio, Speech and Language Processing, Vol. 15, No. 4, May 2007

[NPL 3] Xuejing Sun, "Pitch Detection and Voice Quality Analysis Using Subharmonic-to-Harmonic Ratio", IEEE ICASSP, 333-336, Orlando, 2002

SUMMARY OF INVENTION

Technical Problem

By using time warping, a consistent pitch can be obtained within one frame, which improves coding efficiency. This time warping scheme relies on accuracy of pitch tracking to a certain extent. However, it is difficult to detect the pitch contour with high accuracy because the amplitude and cycle of the audio signal changes.

To improve the accuracy of pitch contour detection, some post processing schemes are introduced such as smoothing, fine tuning threshold parameter, or the like. However, these schemes are based on specific databases. If a time warping scheme is applied based on an inaccurate pitch contour, the sound quality deteriorates and bits are wasted to send time warping information. Therefore, it is necessary to design a time warping scheme which is not blindly guided by detected pitch contours.

Currently, there is no efficient way to code the pitch contour information in the time warping schemes in the prior arts. A fixed table corresponding only to a pitch contour having a small pitch change ratio is used in prior arts. However, in the case where the audio signal has a large pitch change ratio and cannot be covered by the fixed table, the performance of the time warping scheme drops. As described above, a small fixed table is not sufficient for the situation in which the pitches change dramatically. However, a fixed table corresponding to a larger pitch change ratio requires a larger table size, which requires more bits to be used to code the pitch ratio information.

This can be costly especially in low bit-rate coding. Specifically, although coding efficiency can be improved by using a large number of bits when sending the time warping information, bits left for coding the audio signal are not sufficient, which causes deterioration of sound quality.

Therefore, if coding can be performed with fewer bits and efficiently in the time warping scheme, a large number of saved bits can be used to code the audio signal. With this, the sound quality can be improved even when the audio signal is with a larger pitch change.

The present invention has been conceived in view of the above problems, and has an object to provide a coding device, a decoding device, a coding method, and a decoding method by which the sound quality can be improved with a small number of bits even when the audio signal is with a larger pitch change.

Solution to Problem

In order to achieve the above object, a coding device according to an aspect of the present invention includes: a pitch contour detection unit configured to detect a pitch contour that is information indicating a change in pitch of an input audio signal within a period; a dynamic time warping unit configured to: determine the number of pitch nodes that is the number of pitches detected within the period; and generate a first time warping parameter including information indicating the determined number of pitch nodes, a pitch change position, and a pitch change ratio, the pitch change position being a position where the change in pitch occurs in pitches of the number of pitch nodes, the pitch change ratio being a ratio of the change in pitch at the pitch change position; a first encoder which codes the generated first time warping parameter to generate a coded time warping parameter; a time warping unit configured to correct, using the information obtained from the generated first time warping parameter, at least one pitch included in the pitches of the number of pitch nodes, to approximate the pitches of the number of pitch nodes to a predetermined reference value; a second encoder which codes the input audio signal at the pitch corrected by the time warping unit to generate a coded audio signal; and a multiplexer which multiplexes the coded time warping parameter generated by the first encoder and the coded audio signal generated by the second encoder to generate a bitstream.

With this, the coding device: determines the number of pitch nodes based on the detected pitch contour; and generates a first time warping parameter including information indicating the number of pitch nodes, a pitch change position, and a pitch change ratio. Then, the coding device: corrects pitch, using the information obtained from the first time warping parameter, to approximate the pitches of the number of pitch nodes to a predetermined reference value; and generates a bitstream obtained by multiplexing the coded audio signal obtained by coding the input audio signal at the corrected pitch and the coded time warping parameter obtained by coding the first time warping parameter. In this manner, the coding device performs pitch shifting by generating the first time warping parameter by determining an optimal number of pitch nodes in accordance with the detected pitch contour. Therefore, even when the audio signal is with a larger pitch change, a fixed table having a large amount of information is not required, which allows coding to be performed without using a large number of bits. Thus, with the coding device, the sound quality can be improved with a small number of bits even when the audio signal is with a large pitch change.

Furthermore, preferably, the coding device further includes a decoding unit configured to decode the coded time warping parameter generated by the first encoder to generate a second time warping parameter including information indicating the number of pitch nodes, the pitch change position, and the pitch change ratio in the pitch contour within the period, wherein the time warping unit is configured to correct the pitches using the second time warping parameter generated by the decoding unit.

With this, the coding device decodes the generated coded time warping parameter to generate a second time warping parameter including information indicating the number of pitch nodes, the pitch change position, and the pitch change ratio, and corrects the pitches using the generated second time warping parameter. Specifically, the coding device performs pitch shifting by using not the first time warping parameter but the second time warping parameter. The second time warping parameter is generated by decoding the coded time warping parameter obtained by coding the first time warping parameter. Here, the second time warping parameter is a parameter to be used when the audio signal is decoded by the decoding device. Therefore, with the coding device, calculation accuracy in time decompressing processing in decoding can be improved by performing pitch shifting using the same parameter as the parameter used by the decoding device. Thus, with the coding device, the sound quality can be improved with a small number of bits by performing coding with high accuracy even when the audio signal is with a large pitch change.

Furthermore, preferably, the input audio signal includes signals of two channels, the coding device further includes: a main/side (M/S) computation unit configured to calculate a similarity level of pitch contours of the signals of the two channels to generate a flag indicating whether or not the calculated similarity level is greater than a predetermined value; and a down-mix unit configured to: output one signal obtained by down-mixing the signals of the two channels when the generated flag indicates that the similarity level is greater than the predetermined value; and output the signals of the two channels when the flag indicates that the similarity level is less than or equal to the predetermined value, and the pitch contour detection unit is configured to detect the pitch contour for each of the signals outputted by the down-mix unit.

With this, the coding device: calculates a similarity level of pitch contours of the signals of the two channels which are input audio signals; outputs one signal obtained by down-mixing the signals of the two channels when the similarity level is greater than the predetermined value; and outputs the signals of the two channels when the similarity level is less than or equal to the predetermined value. Specifically, when the similarity level of pitch contours of the signals of the two channels is high, the coding device generates one first time warping parameter common to the signals of the two channels based on the pitch contour of one of the signals. In this manner, with the coding device, it is sufficient to code one first time warping parameter to code the signals of the two channels, which can reduce the number of bits to be used. Therefore, the sound quality can be improved with a small number of bits even when the audio signal is with a large pitch change.

Furthermore, preferably, the coding device further includes a comparison unit configured to compare a first coded signal with a second coded signal, the first coded signal being the coded audio signal generated by the second encoder, the second coded signal being obtained by coding the input audio signal through another coding scheme, wherein the comparison unit is configured to: decode the first coded signal using the coded time warping parameter generated by the first encoder to calculate a first difference that is a difference between the input audio signal and the decoded first coded signal; decode the second coded signal to calculate a second difference that is a difference between the input audio signal and the decoded second coded signal; and output the first coded signal when the first difference is less than the second difference, and the multiplexer multiplexes the first coded signal outputted by the comparison unit and the coded time warping parameter to generate the bitstream.

With this, the coding device: compares a first coded signal with a second coded signal, the first coded signal being the generated coded audio signal, the second coded signal being obtained by coding the input audio signal through another coding scheme; and outputs the first coded signal when the difference between the input audio signal and the decoded first coded signal is less than the difference between the input audio signal and the decoded second coded signal. Specifically, the coding device outputs the generated coded audio signal only when the coding is performed with high accuracy. Thus, with the coding device, the sound quality can be improved with a small number of bits by performing coding with high accuracy even when the audio signal is with a large pitch change.

Furthermore, in order to achieve the above object, a decoding device according to an aspect of the present invention includes: a demultiplexer which demultiplexes a coded audio signal and a coded time warping parameter from a bitstream, the coded audio signal being obtained by coding a pitch-corrected audio signal, the coded time warping parameter being obtained by coding a first time warping parameter for correcting pitches, the bitstream being obtained by multiplexing the coded audio signal and the coded time warping parameter; a first decoding unit configured to decode the coded time warping parameter to generate a second time warping parameter including information indicating the number of pitch nodes, a pitch change position, and a pitch change ratio, the number of pitch nodes being the number of pitches detected within a period, the pitch change position being a position where a change in pitch occurs in pitches of the number of pitch nodes, the pitch change ratio being a ratio of the change at the pitch change position; a second decoding unit configured to decode the coded audio signal to generate a pitch-corrected audio signal obtained by correcting pitch to approximate the pitches of the number of pitch nodes to a predetermined reference value; and a time warping unit configured to transform, using the second time warping parameter, the pitch-corrected audio signal into an audio signal before correction by changing at least one pitch included in the pitches of the number of pitch nodes, to restore the pitches of the number of pitches to pitches before correction.

With this, the decoding device: demultiplexes a coded audio signal and a coded time warping parameter from a bitstream; and decodes the coded time warping parameter to generate a second time warping parameter including information indicating the number of pitch nodes, a pitch change position, and a pitch change ratio. Then, the decoding device: decodes the coded audio signal to generate a pitch-corrected audio signal; and transforms, using the second time warping parameter, the audio signal into an audio signal before correction by changing pitch to restore the pitches of the number of pitch nodes to pitches before correction. In this manner, the decoding device: decodes the coded time warping parameter to generate a second time warping parameter; and restores the audio signal to an audio signal before correction by restoring the pitches of the number of pitch nodes to pitches before correction. Therefore, even when decoding the audio signal with a large pitch change, the decoding device decodes the coded time warping parameter generated without using a fixed table having the large amount of information. Therefore, the fixed table having a large amount of information is not required. Specifically, the decoding device can perform decoding without using a large number of bits. Thus, with the decoding device, the sound quality can be improved with a small number of bits even when the audio signal is with a large pitch change.

Furthermore, preferably, the audio signal includes signals of two channels, the decoding device further includes an M/S mode detection unit configured to generate a flag indicating whether or not a similarity level of pitch contours of the signals of the two channels is greater than a predetermined value, and the first decoding unit is configured to: generate the second time warping parameter common to the signals of the two channels when the generated flag indicates that the similarity level is greater than the predetermined value; and to generate the second time warping parameter for each of the signals of the two channels when the generated flag indicates that the similarity level is less than or equal to the predetermined value.

With this, the decoding device: generates the second time warping parameter common to the signals of the two channels which are input audio signals when the similarity level of pitch contours of the signals of the two channels is greater than the predetermined value; and generates the second time warping parameter for each of the signals of the two channels when the similarity level is less than or equal to the predetermined value. Specifically, when the similarity level of the pitch contours of the signals of the two channels is high, the decoding device generates one second time warping parameter. In this manner, with the decoding device, it is sufficient to use only one second time warping parameter to decode the signals of the two channels, which can reduce the number of bits to be used. Therefore, with the decoding device, the sound quality can be improved with a small number of bits even when the audio signal is with a large pitch change.

Furthermore, the present invention can be implemented not only as the coding device or the decoding device described above but also as a coding method or a decoding method including the characteristic processing performed by processing units included in the coding device or the decoding device as steps. Furthermore, the present invention can be implemented as a program or an integrated circuit which causes a computer to execute characteristic processing included in the coding method or the decoding method. Such a program may be distributed via a recording medium such as a CD-ROM or the like or a transmission medium such as the Internet or the like.

Advantageous Effects of Invention

With the coding device according to the present invention, sound quality can be improved with a small number of bits even when the audio signal is with a large pitch change.

DESCRIPTION OF EMBODIMENTS

The following describes a coding device and a decoding device according to embodiments of the present invention with reference to drawings.

It is to be noted that each of the embodiments described below shows a preferable specific example of the present invention. Numeric values, constituents, positions, and topologies of the constituents, steps, an order of the steps, and the like in the following embodiments are an example of the present invention, and it should therefore not be construed that the present invention is limited to the embodiments. The present invention is determined only by the statement in Claims. Accordingly, out of the constituents in the following embodiments, the constituents not stated in the independent claims describing the broadest concept of the present invention are not necessary for achieving the object of the present invention and are described as constituents in a more preferable embodiment.

Specifically, the embodiments below are a mere example for describing the principles of various inventive steps. It is understood that variations of the details described herein will be apparent to others skilled in the art.

[Embodiment 1]

In Embodiment 1, a coding device applied with a dynamic time warping scheme is proposed.

Figure 1A:
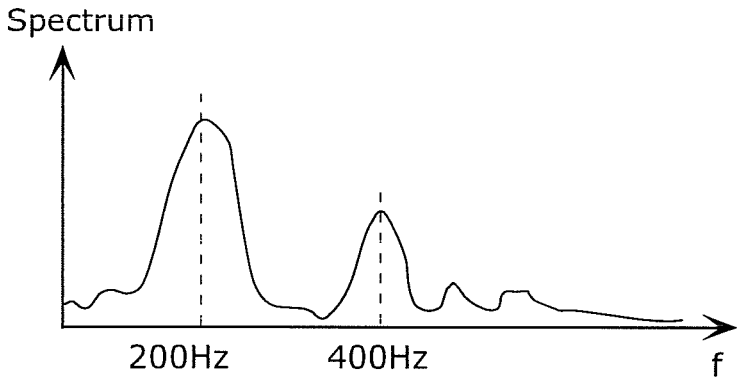
FIG. 1A shows an example of the conventional scheme of pitch shifting.
Figure 1B:
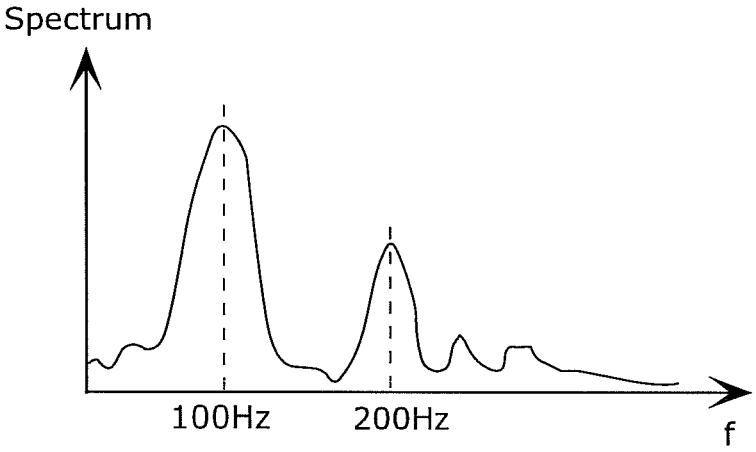
FIG. 1B shows an example of the conventional scheme of pitch shifting.
Figure 2A:
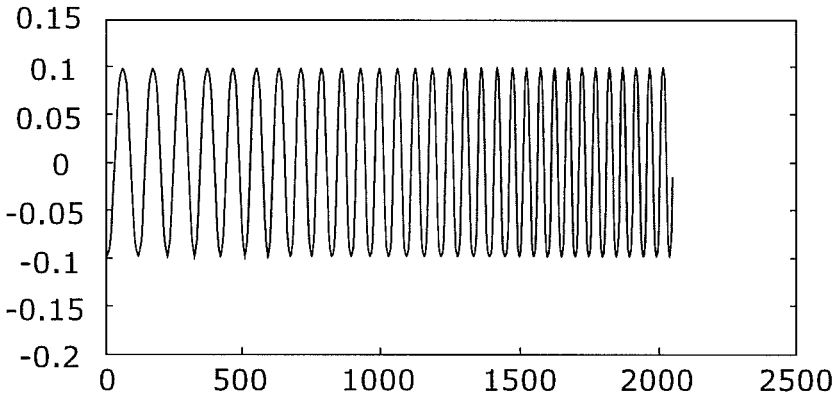
FIG. 2A shows a sweep signal before pitch shifting in the conventional pitch shifting of audio signals.
Figure 2B:
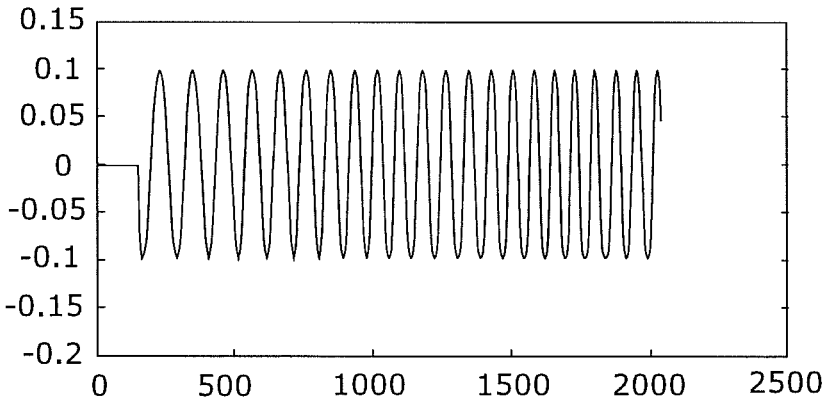
FIG. 2B shows a sweep signal after pitch shifting in the conventional pitch shifting of audio signals.
Figure 2C:
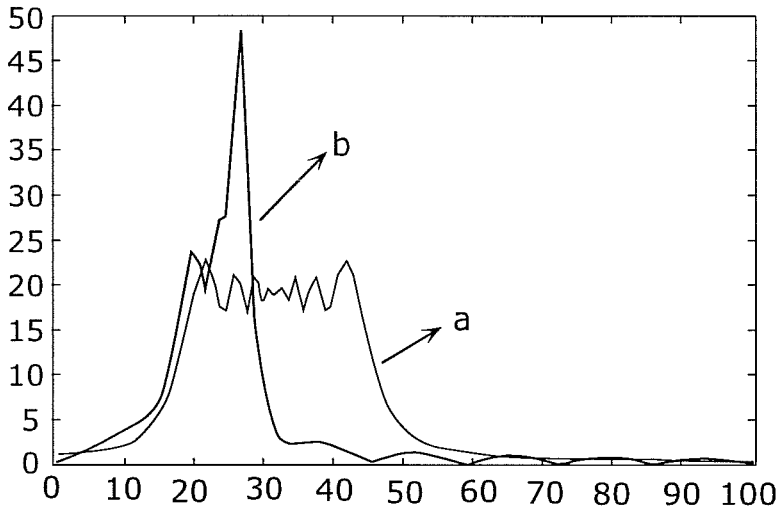
FIG. 2C shows a spectrum before and after pitch shifting in the conventional pitch shifting of audio signals.
Figure 3:
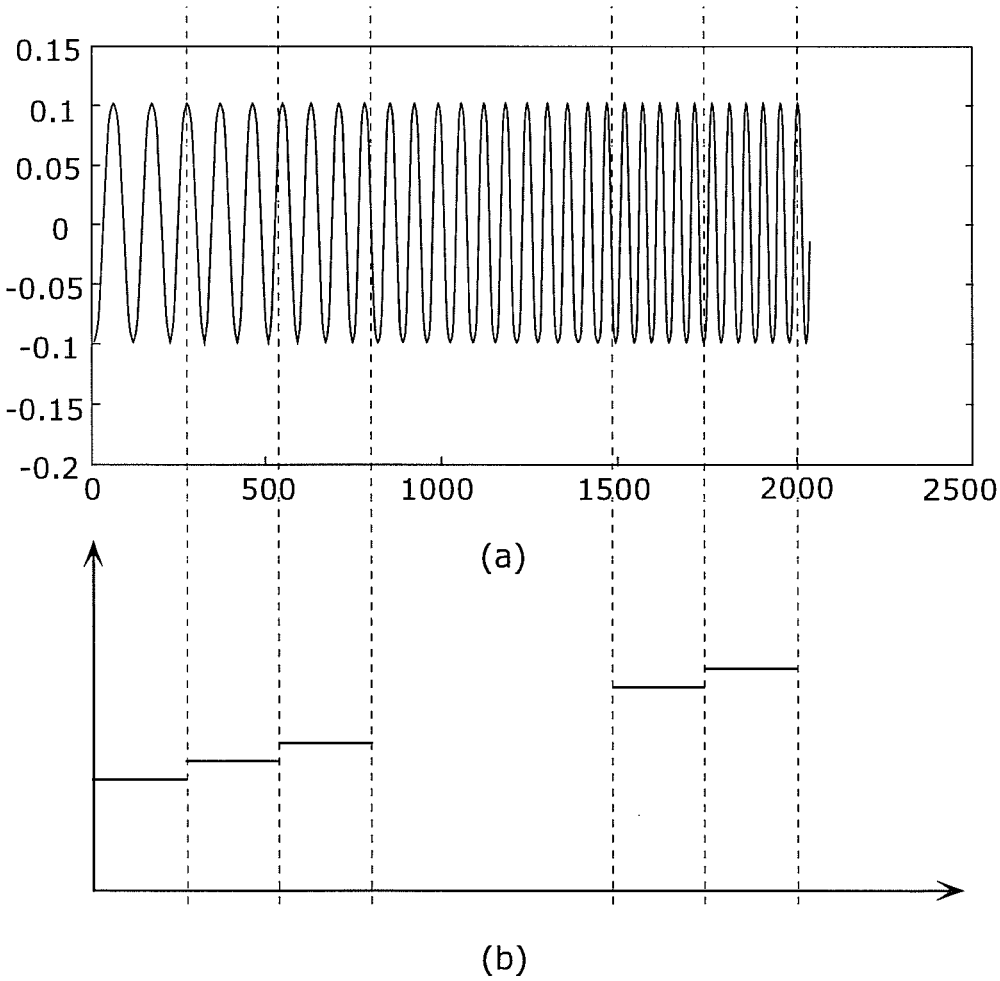
FIG. 3 shows a conventional calculation scheme of pitch contours of audio signals.
Figure 4:
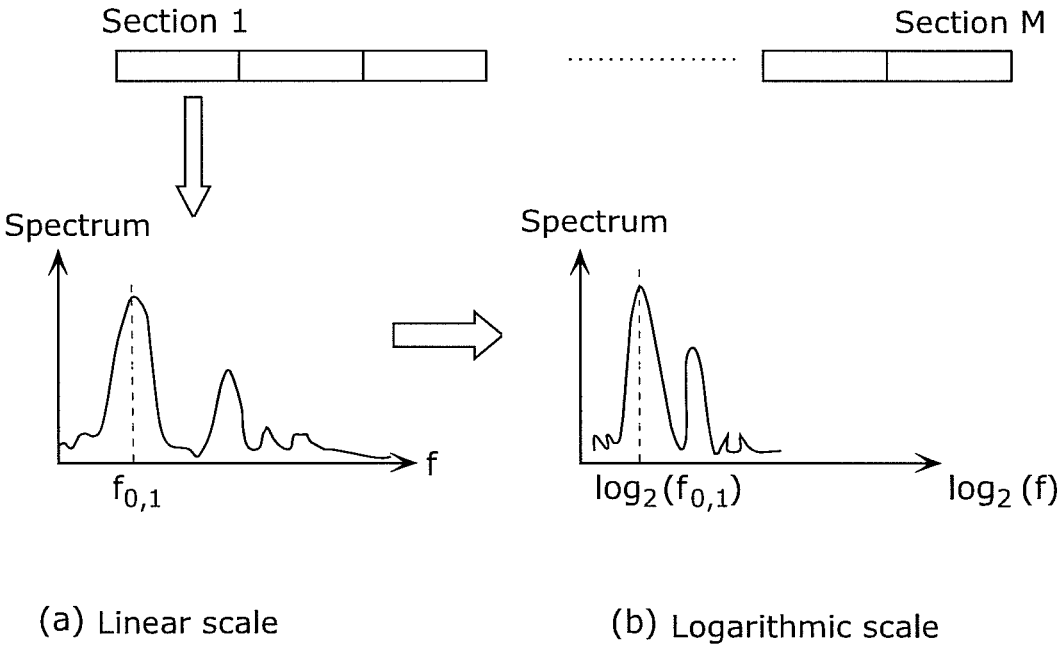
FIG. 4 shows a conventional calculation scheme of pitch contours of audio signals.
Figure 5:
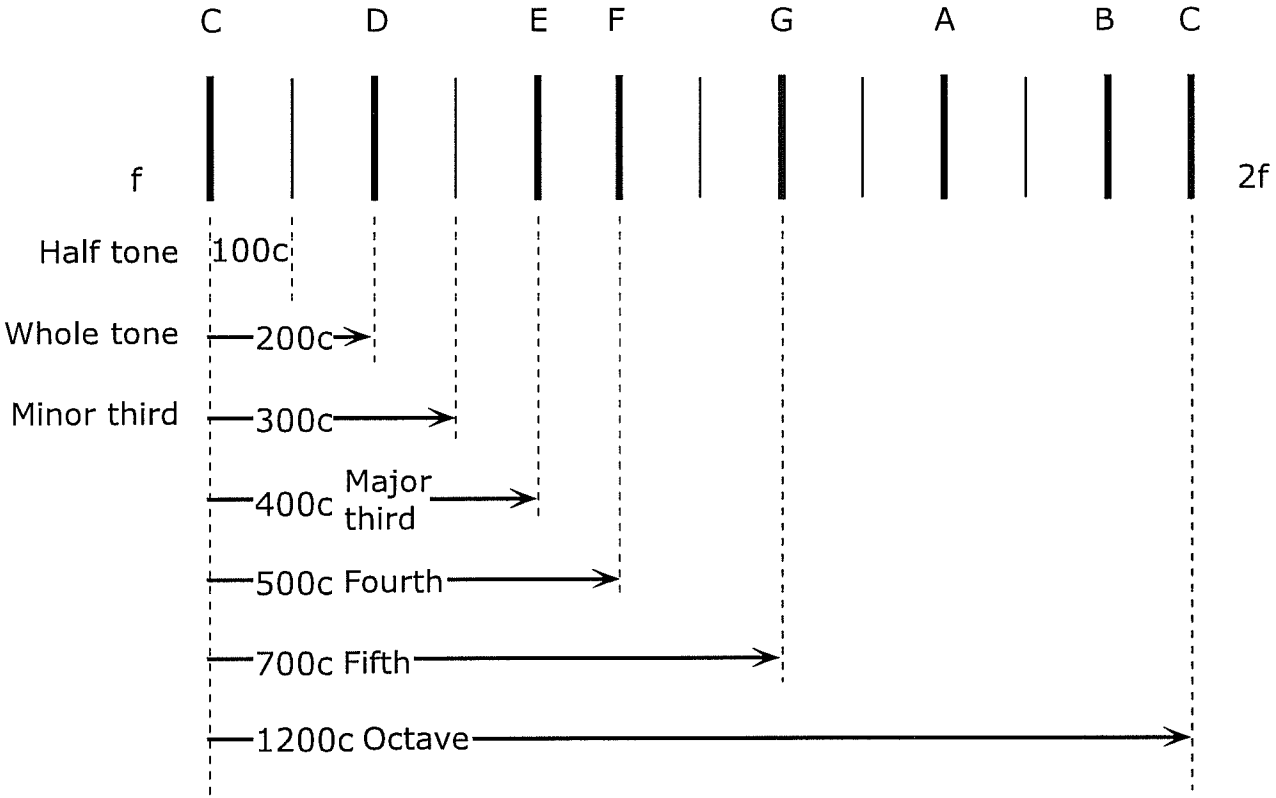
FIG. 5 shows the measurement of cent and half tone.
Figure 6:
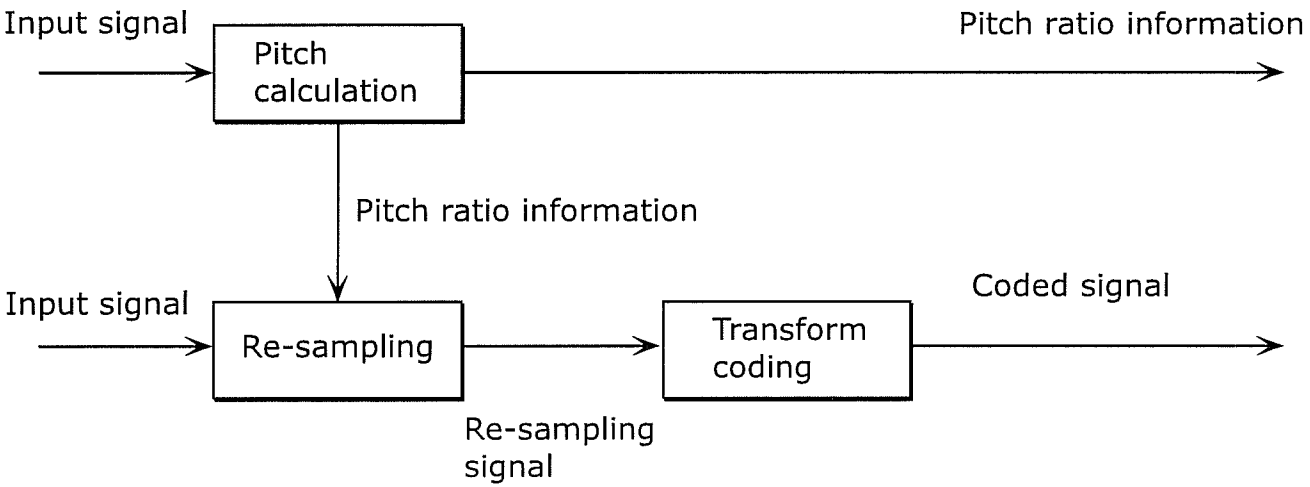
FIG. 6 shows a coding device and a decoding device applied with the time warping scheme.
Figure 7:
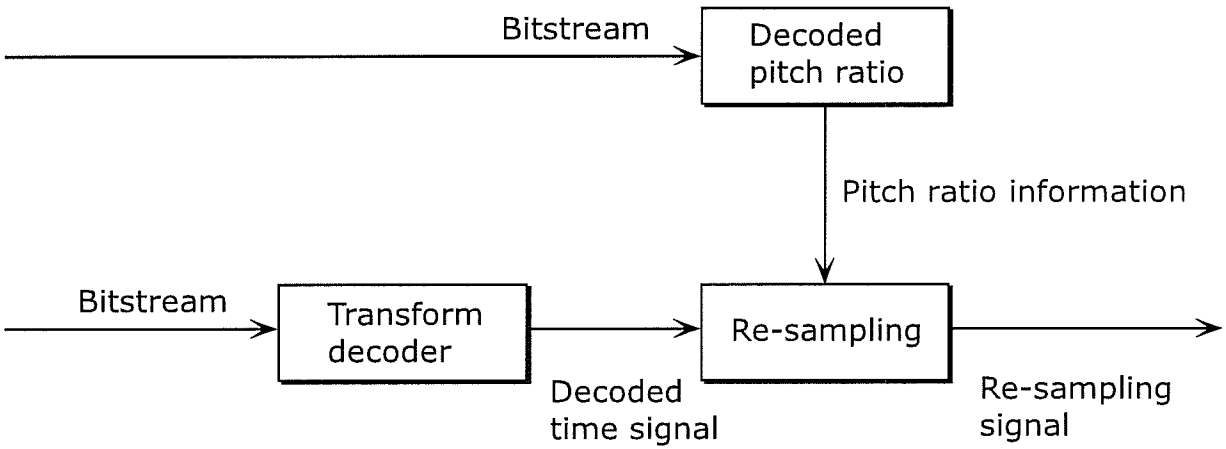
FIG. 7 shows a coding device and a decoding device applied with the time warping scheme.
Figure 8:
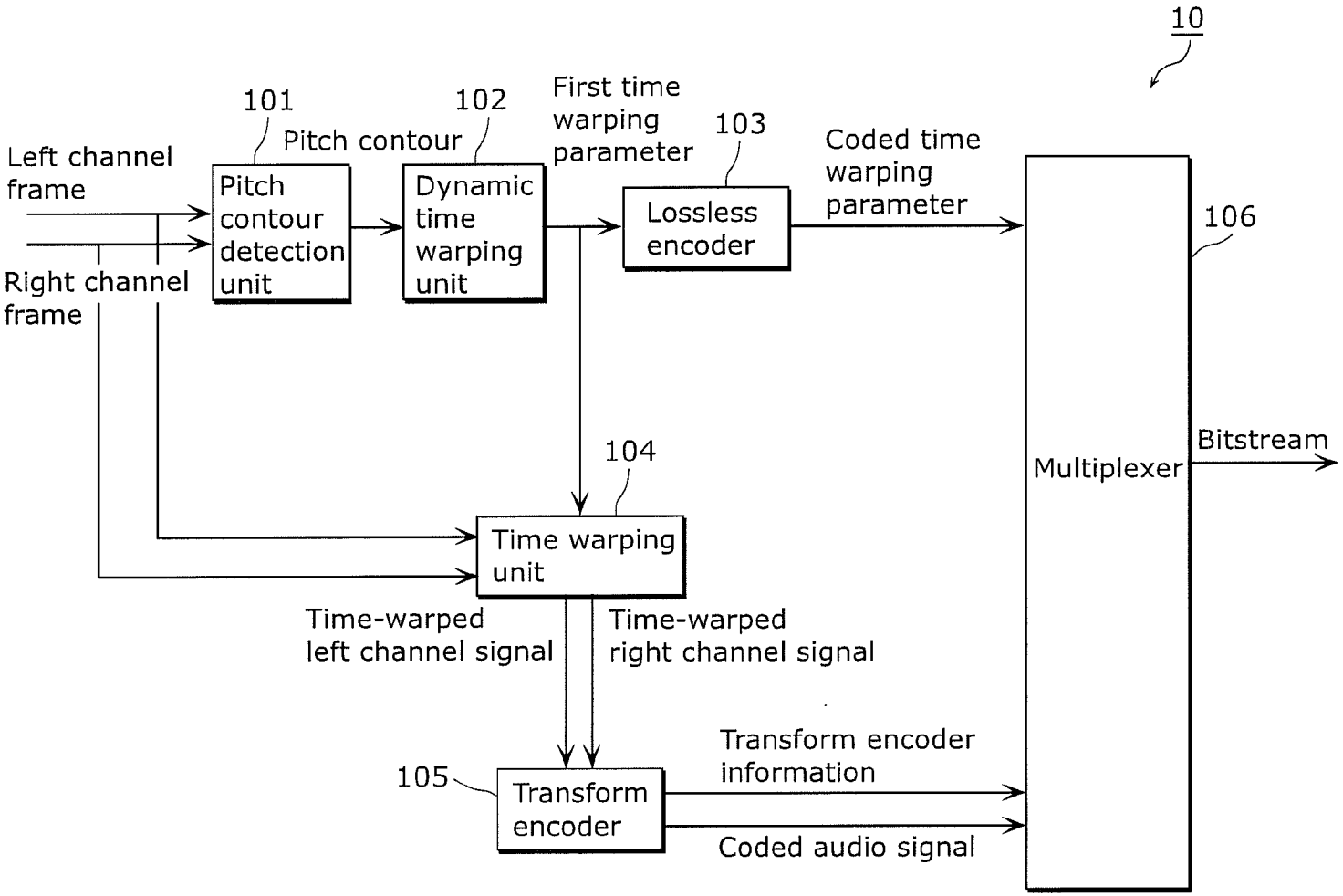
FIG. 8 is a block diagram showing a functional configuration of a coding device according to Embodiment 1 of the present invention.

FIG. 8 is a block diagram showing a functional configuration of a coding device 10 according to Embodiment 1 of the present invention.

As shown in FIG. 8, the coding device 10 is a device which codes an input audio signal that is an audio signal to be inputted, and includes a pitch contour detection unit 101, a dynamic time warping unit 102, a lossless encoder 103, a time warping unit 104, a transform encoder 105, and a multiplexer 106.

The pitch contour detection unit 101 detects a pitch contour that is information indicating a change in pitch of an input audio signal within a period.

Specifically, one frame of each of input audio signals of a right channel and a left channel is inputted to the pitch contour detection unit 101. Then, the pitch contour detection unit 101 detects a pitch contour of each of the input audio signals of the right channel and the left channel. The pitch contour detection algorithm is described in the prior arts.

The dynamic time warping unit 102: determines, based on the pitch contour detected by pitch contour detection unit 101, the number of pitch nodes that is the number of pitches detected within the period; and generates a first time warping parameter including information indicating the determined number of pitch nodes, a pitch change position, and a pitch change ratio. The pitch change position is a position where the change in pitch occurs in pitches of the number of pitch nodes, and the pitch change ratio is a ratio of the change in pitch at the pitch change position.

Figure 9:
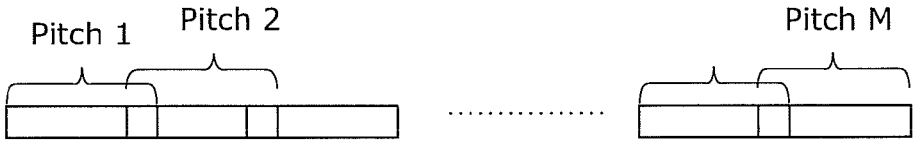
FIG. 9 illustrates the number of pitch nodes determined by a dynamic time warping unit according to Embodiment 1 of the present invention.

More specifically, the dynamic time warping unit 102 determines the number of pitch nodes M based on the pitch contour, and segments one frame into overlapped sections of M pitch nodes, as illustrated in FIG. 9. FIG. 9 illustrates the number of pitch nodes determined by the dynamic time warping unit 102 according to Embodiment 1 of the present invention. Here, a numerical value of the number-of-pitch-nodes M is not limited. However, it is preferable that M is the optimal number of pitch nodes obtained by analyzing the pitch contour.

Then, the dynamic time warping unit 102 calculates pitches of M pitch nodes from the sections of M pitch nodes within the one frame. Then, the dynamic time warping unit 102 obtains pitch change positions from the calculated pitches of M pitch nodes to calculate a pitch change ratio.

In this manner, the dynamic time warping unit 102 processes the pitch contour to generate, based on harmonic structure, a first time warping parameter including information indicating the number of pitch nodes, a pitch change position, and a pitch change ratio.

The lossless encoder 103 is a first encoder which codes the first time warping parameter generated by the dynamic time warping unit 102 to generate a coded time warping parameter.

Specifically, the first time warping parameter is sent to the lossless encoder 103. Then, the lossless encoder 103 compresses the first time warping parameter, and generates the coded time warping parameter. Then, the coded time warping parameter is sent to the multiplexer 106.

The time warping unit 104 corrects, using the information obtained from the first time warping parameter generated by the dynamic time warping unit 102, at least one pitch included in the pitches of M pitch nodes, to approximate the pitches of M pitch nodes to a predetermined reference value.

Specifically, the first time warping parameter is sent to the time warping unit 104. The processing of the time warping unit 104 is described in the prior arts. The time warping unit 104 re-samples the input audio signal according to the first time warping parameter. When the input audio signal is a stereo signal, pitch shifting (time warping) is performed on each of the right signal and the left signal according to the corresponding first time warping parameter.

The transform encoder 105 is a second encoder which codes the input audio signal at the pitch corrected by the time warping unit 104 to generate a coded audio signal.

Specifically, the time-warped signal of the right channel and the time-warped signal of the left channel are sent to and coded by the transform encoder 105. Then, the coded audio signal and transform encoder information are sent to the multiplexer 106.

The multiplexer 106 multiplexes the coded time warping parameter generated by the lossless encoder 103 that is the first encoder, the coded audio signal generated by the transform encoder 105 that is the second encoder, and the transform encoder information, to generate a bitstream.

It is to be noted that the input audio signal inputted to the pitch contour detection unit 101 is not necessarily a stereo signal, and may be a monaural signal or a multi signal. The dynamic time warping scheme used by the coding device 10 can be applied to any number of channels.

The following describes processing of coding an input audio signal performed by the coding device 10.

Figure 10:
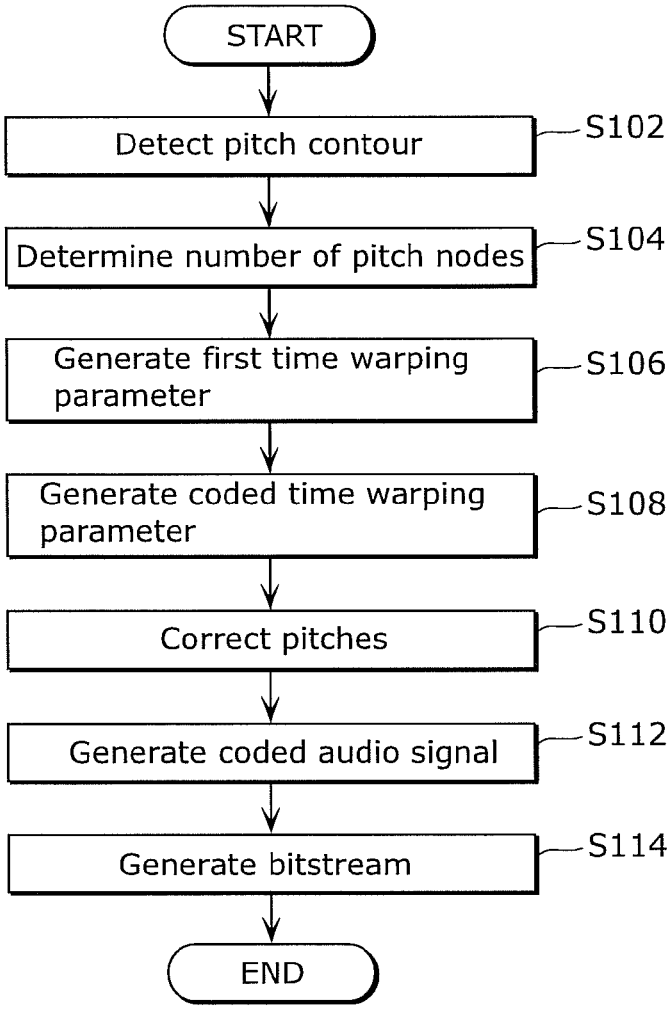
FIG. 10 is a flowchart showing an example of processing of coding of an input audio signal performed by the coding device according to Embodiment 1 of the present invention.

FIG. 10 is a flowchart showing an example of processing of coding of an input audio signal performed by the coding device 10 according to Embodiment 1 of the present invention.

As shown in FIG. 10, the pitch contour detection unit 101 first detects a pitch contour of an input audio signal (S102).

Then, the dynamic time warping unit 102 determines the number of pitch nodes based on the pitch contour detected by the pitch contour detection unit 101 (S104).

Then, the dynamic time warping unit 102 generates, based on the pitch contour, a first time warping parameter including information indicating the determined number of pitch nodes, a pitch change position, and a pitch change ratio (S106).

Next, the lossless encoder 103 codes the first time warping parameter generated by the dynamic time warping unit 102 to generate a coded time warping parameter (S108).

Furthermore, the time warping unit 104 corrects, using the information obtained from the first time warping parameter generated by the dynamic time warping unit 102, at least one pitch included in the pitches of the number of pitch nodes, to approximate the pitches of the number of pitch nodes to a predetermined reference value (S110).

Then, the transform encoder 105 codes the input audio signal at the pitch corrected by the time warping unit 104 to generate a coded audio signal (S112).

Then, the multiplexer 106 multiplexes the coded time warping parameter generated by the lossless encoder 103, the coded audio signal generated by the transform encoder 105, and the transform encoder information, to generate a bitstream (S114).

With the above, the processing of coding an input audio signal performed by the coding device 10 is finished.

As stated in Technical Problem, an inaccurate pitch contour causes sound quality deterioration after time warping. A dynamic time warping scheme is proposed to overcome this problem. This is a time warping scheme which also takes the harmonic structure into consideration. Specifically, during time warping, the harmonics are modified along with pitch shifting, and it is necessary to take the signal's harmonic structures during time warping into consideration. Then, with the harmonic time warping scheme used by the coding device 10, the pitch contour is modified based on the analysis of the harmonic structures. With this scheme, the sound quality is improved by taking the harmonic structure into consideration during time warping.

In this manner, in Embodiment 1, the pitch contour is processed through a dynamic time warping scheme to generate a dynamic time warping parameter. The dynamic time warping parameter represents the number of pitches, positions where time warping is applied, and time warping values of the corresponding positions. The sound quality is improved through the proposed dynamic time warping scheme. Furthermore, a lossless coding is also introduced to further reduce the bits for coding the time warping values.

As described above, with the coding device 10 according to Embodiment 1, the number of pitch nodes is determined based on the detected pitch contour, and a first time warping parameter is generated including information indicating the number of pitch nodes, a pitch change position, and a pitch change ratio. Then, the coding device 10: corrects pitch, using the information obtained from the first time warping parameter, to approximate the pitches of the number of pitch nodes to a predetermined reference value; and generates a bitstream obtained by multiplexing the coded audio signal obtained by coding the input audio signal at the corrected pitch and the coded time warping parameter obtained by coding the first time warping parameter. In this manner, the coding device 10 performs pitch shifting by generating the first time warping parameter by determining an optimal number of pitch nodes in accordance with the detected pitch contour. Therefore, even when the audio signal is with a larger pitch change, a fixed table having a large amount of information is not required, which allows coding to be performed without using a large number of bits. Thus, with the coding device 10, the sound quality can be improved with a small number of bits even when the audio signal is with large pitch change.

[Embodiment 2]

In Embodiment 2, a dynamic time warping scheme performed by the coding device 10 is described which includes a scheme for modifying a pitch contour according to the harmonic structures.

As explained in the above Technical Problem, pitch contour detection is difficult since the amplitude and cycle of the audio signal change. In the case where pitch contour information is directly used for time warping, when a pitch contour is inaccurate, performance of time warping is affected. Since the harmonics of the signal are modified in proportion to pitch shifting during time warping, the effect of time warping on the harmonics has to be taken into consideration.

In Embodiment 2, a dynamic time warping scheme is proposed. A pitch contour is modified by analyzing harmonic structure, and effective first time warping parameter is generated.

This dynamic time warping scheme includes three parts. In a first part, the pitch contour is modified according to the harmonic structure. In a second part, the performance of time warping is evaluated by comparing the harmonics structure before and after time warping. In a third part, an effective representation scheme for the first time warping parameter is used. Unlike the prior arts in which the whole pitch contour is coded, information on the position where time warping is performed is coded, and a time warping value of the corresponding position is coded through lossless coding.

In the first part, pitch contour is modified. According to Embodiment 1, a frame is segmented into M sections for pitch calculation. The pitch contour includes M pitch values ($pitch_1, pitch_2, \ldots pitch_M$). In the prior arts, pitches are shifted close to a reference pitch. After time warping, a consistent reference pitch is obtained.

Figure 11:
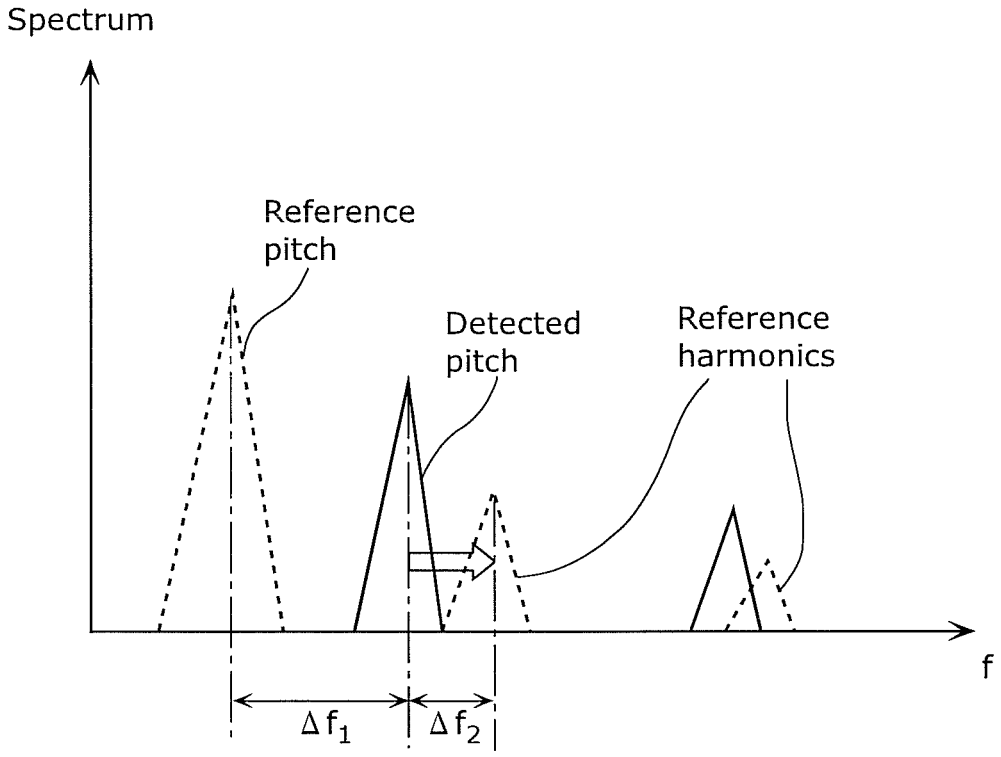
FIG. 11 illustrates a dynamic time warping scheme used by a coding device according to Embodiment 2 of the present invention.

In contrast, with the proposed dynamic time warping scheme, the harmonics of a signal can be shifted close to the harmonics of the reference pitch. An example is illustrated in FIG. 11. FIG. 11 illustrates a dynamic time warping scheme used by the coding device 10 according to Embodiment 2 of the present invention.

As shown in FIG. 11, the detected pitch is close to the harmonic of the reference pitch. Specifically, since $\Delta f_1 > \Delta f_2$, although a greater warping value has to be used for shifting the detected pitch to the reference pitch, a less warping value can be used for shifting the detected pitch to the harmonic of the reference pitch.

In this manner, in the dynamic time warping scheme, harmonic components can be shifted by modifying the pitch contour. The modification process is described below.

Firstly, in the proposed dynamic time warping scheme, a difference between the detected pitch and the reference pitch is compared. More specifically, when a reference pitch is represented by $pitch_{ref}$ and a detected pitch in a section i is represented by pitch', and if $pitch_i > pitch_{ref}$, it is checked whether the detected pitch $pitch_i$ is closer to the reference pitch $pitch_{ref}$ or to the harmonics of the reference pitch $k \times pitch_{ref}$. Here, k is an integer and k>1.

Then, if a k which satisfies the expression below exists, the detected pitch $pitch_i$ is shifted to the reference harmonics $k \times pitch_{ref}$. The detected pitch $pitch_i$ is modified to $k \times pitch_{ref}$.

$$|pitch_i - pitch_{ref}| > |pitch_i - k \times pitch_{ref}| \quad \text{[Math 2]}$$

Furthermore, if $pitch_i < pitch_{ref}$, it is checked whether the reference pitch $pitch_{ref}$ is closer to the detected pitch $pitch_i$ or to the harmonics of the detected pitch $pitch_i$. When a k which satisfies the expression below exists, the harmonics of the detected pitch $pitch_i$ is shifted to the reference pitch. Therefore, the detected pitch $pitch_i$ is modified to $k \times pitch_i$.

$$|pitch_i - pitch_{ref}| > |k \times pitch_i - pitch_{ref}|$$

In the second part, based on this modified pitch contour, time warping is applied and performance is evaluated by comparing the harmonic structure before and after the time warping. The summation of harmonic components before and after the time warping is used as the criteria for performance evaluation in Embodiment 2.

The calculation of the harmonic is as below.

$$H(pitch_i) = \sum_{k=1}^{q} S(k \times pitch_i) \quad \text{[Math 4]}$$

Here, q is the number of harmonic components. In Embodiment 2, q=3 is suggested. S ( ) denotes the spectrum of the signal, and pitch, is $pitch_1$, $pitch_2$, . . . and $pitch_M$ detected from the pitch contour.

After time warping, the harmonic summation is as below.

$$H'(pitch_i) = \sum_{k=1}^{q} S'(k \times pitch_i) \quad \text{[Math 5]}$$

Here, S'( ) denotes the spectrum of the signal after time warping.

Before time warping, the signal consists of harmonics $pitch_1$, $pitch_2$, . . . and $pitch_M$. A harmonic ratio HR is defined to represent the energy distribution among these harmonic components.

$$HR = \frac{\max(\hat{H})}{\min(\hat{H})} \quad \text{[Math 6]}$$

$$\hat{H} \quad \text{[Math 7]}$$

The math above consists of harmonic summation of the pitches, namely $pitch_1$, $pitch_2$, . . . and $pitch_M$.

After time warping, the harmonic ratio HR' is calculated as below.

$$HR = \frac{\max(H'(pitch_{ref}))}{\min(\hat{H}')} \quad \text{[Math 8]}$$

$H'(pitch_{ref})$ is the harmonic summation of the reference pitch after time warping.

$$\hat{H}' \quad \text{[Math 9]}$$

consists of harmonic summation of the pitches, namely $pitch_1$, $pitch_2$, . . . and $pitch_M$.

It is expected that after time warping, energy is confined to the reference pitch, and energy of other pitches is reduced. Therefore, HR'>HR is expected. Time warping is considered to be effective when HR'>HR and time warping is applied for this frame.

The third part of dynamic time warping is to generate the first time warping parameter using an efficient scheme. Since the pitch change positions included in a frame are not so many within a frame, an efficient scheme may be designed to code the pitch change positions and the values $\Delta p_i$ separately.

Firstly, the modified pitch contour is normalized. Secondly, a difference between adjacent modified pitch is calculated.

$$\Delta p_i = \frac{pitch_i}{pitch_{i-1}} \quad \text{[Math 10]}$$

What is different from the prior arts is that the present dynamic time warping scheme does not code the whole vector of the math below.

$$\Delta\hat{p} \quad \text{[Math 11]}$$

A vector C is used to indicate the position where $\Delta p_i \neq 1$. This is the position where time warping is performed. Only a time warping value $\Delta p_i$ where $\Delta p_i \neq 1$ is coded by the lossless encoder 103.

Figure 12:
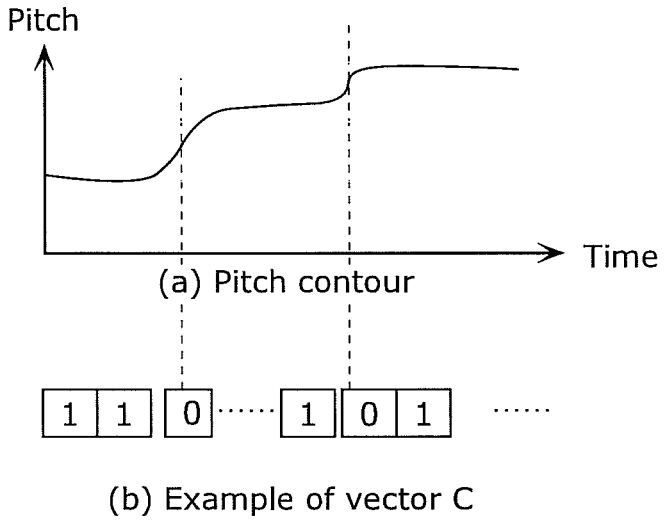
FIG. 12 illustrates a first time warping parameter generated by a dynamic time warping unit according to Embodiment 2 of the present invention.

If $\Delta p_i = 1$, C(i) is set to 1. Otherwise, C(i) is set to 0. Each element of the vector C corresponds to one section in the modified pitch contour. A setting example of the vector C is shown in FIG. 12. FIG. 12 illustrates a first time warping parameter generated by the dynamic time warping unit 102 according to Embodiment 2 of the present invention.

More specifically, the dynamic time warping unit 102 codes the vector C (pitch change position) and the time warping values (pitch change ratio) $\Delta p_i$ where $\Delta p_i \neq 1$, through the scheme shown in any one of steps 1 to 3 below. It is to be noted that a flag A is generated to indicate which scheme is selected.

Step 1: the dynamic time warping unit 102 checks whether there are any pitch change positions in the current frame. If N=0, it means there is no pitch change position. Here, N is defined as the number of pitch change positions, that is, the number of sections where $\Delta p_i \neq 1$. Then, the dynamic time warping unit 102 sets the flag A to 0. In this case, the dynamic time warping unit 102 sends only the flag A to the lossless encoder 103.

Step 2: if there are one or more pitch change positions in the current frame, the dynamic time warping unit 102 needs to send the time warping values $\Delta p_i$ where $\Delta p_i \neq 1$ and the vector C to the lossless encoder 103.

$$N \times \log_2 M + \log_2\left(\frac{M}{\log_2 M}\right) > M \quad \text{[Math 12]}$$

If the above expression is satisfied, it means there are many pitch change positions. For this situation, it is more efficient to directly code the vector C and $\Delta p_i$ where $\Delta p_i \neq 1$.

In this case, the flag A is set to 1, and the vector C is coded using M bits. For example, when the vector C=00001111, 8 bits are used to represent this vector C. The dynamic time warping unit 102 sends the flag A, the vector C, and the $\Delta p_i$ where $\Delta p_i \neq 1$, to the lossless encoder 103.

Step 3: if N>0 and the expression below is satisfied, it means there are a small number of pitch change positions.

$$N \times \log_2 M + \log_2\left(\frac{M}{\log_2 M}\right) \leq M \quad \text{[Math 13]}$$

In this case, it is more efficient to code the pitch change position directly. Therefore, the flag A is set to 2, and the position marked as 0 in the vector C is coded using $\log_2 M$ bits. $\text{Log}_2(M/\text{long}_2 M)$ bits are used to code N that is the number of the pitch change positions.

For example, if the vector C=10111111, pitch change position is 2. 3 bits are used to code the position 2. The dynamic time warping unit 102 sends, to the lossless encoder 103, the flag A, the number-of-pitch-change-positions N, the pitch change position, and the $\Delta p_i$ where $\Delta p_i \neq 1$.

A result of statistical analysis on $\Delta p_i$ shows that the probability of values $\Delta p_i$ is not even, and bit-rate can be saved by using the lossless coding. The lossless encoder 103 codes the pitch change ratio $\Delta p_i$ where $\Delta p_i \neq 1$, through the Arithmetic coding or the Huffman coding.

In order to reduce the complexity, it is sufficient to apply only the first two schemes (Steps 1 and 2) to the dynamic time warping unit 102.

In the prior arts, the pitch contour information is sent to the decoder directly without applying any compression scheme. Here, as a result of statistical analysis on the pitch contour for time warping in the course of earnest research, the inventors of the present invention found that time warping is performed only at a few positions where the pitch changes within a frame of a signal.

Therefore, it is more efficient to code only the information to which time warping has been applied. Furthermore, the lossless coding is used to code the first time warping parameter according to the uneven probability of pitch change, which saves the bits.

The present dynamic time warping scheme includes information on the position where time warping is applied and the time warping values of the corresponding positions. Therefore, coding is not performed on the whole pitch contour using a fixed table as described in the prior arts, which saves the bits. The present dynamic time warping scheme also supports a wider range of time warping values. The saved bits are used in coding an input audio signal, and the sound quality is improved as the range of time warping values is wider.

As described above, with the dynamic time warping scheme according to Embodiment 2, the harmonic structure can be reconfigured through time warping. The coding efficiency is improved since the energy is confined to the reference pitch and the harmonic components. Furthermore, with the present scheme, the dependence on the accuracy of pitch detection is lowered and performance of coding is improved. With the present scheme which efficiently codes the first time warping parameter, the sound quality can be improved by reducing the bit-rate, thereby supporting coded signals with larger pitch change ratio.

[Embodiment 3]

Figure 13:
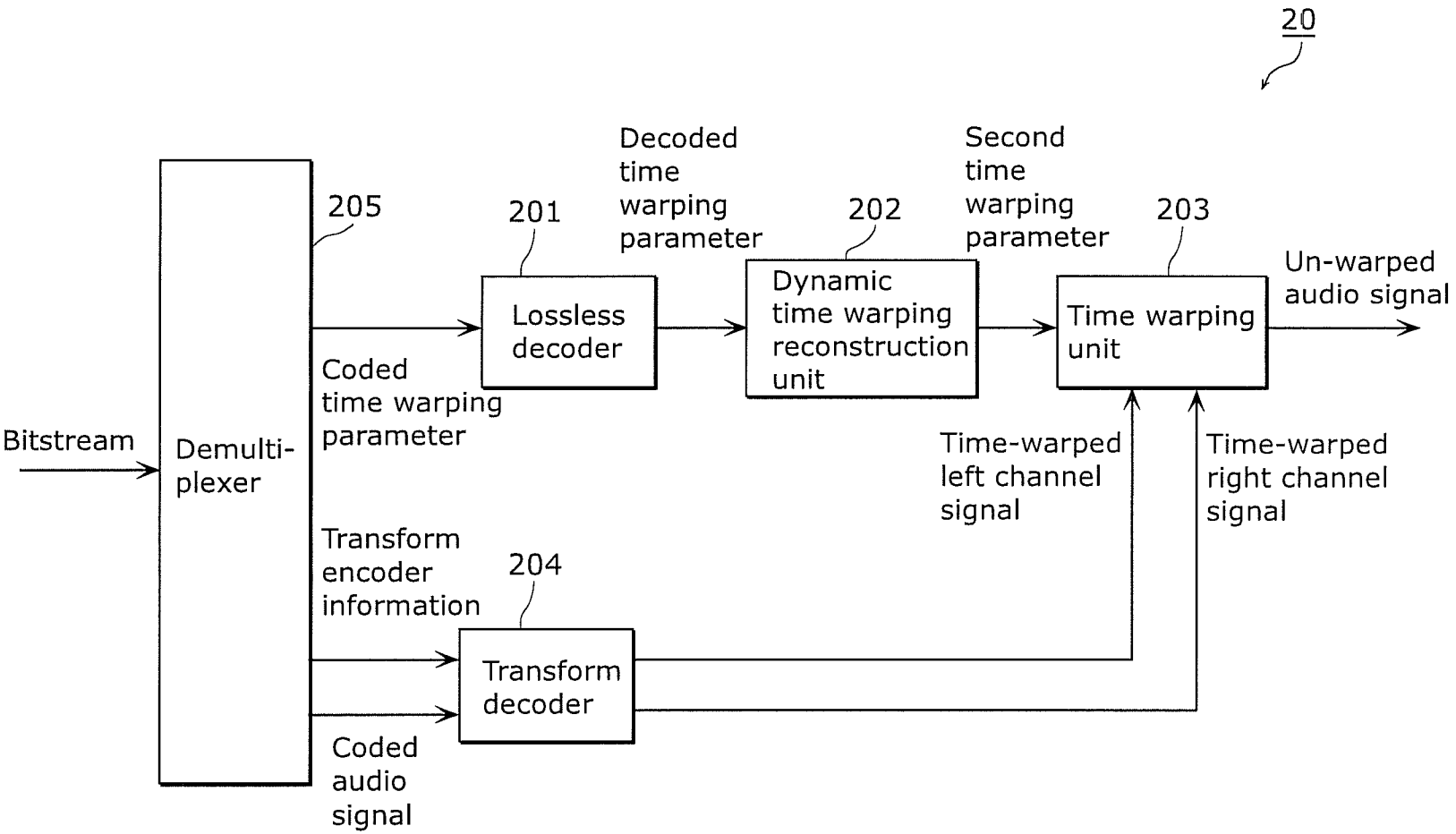
FIG. 13 is a block diagram showing a functional configuration of a decoding device according to Embodiment 3 of the present invention.

In Embodiment 3, a decoding device applied with the dynamic time warping scheme is proposed. FIG. 13 is a block diagram showing a functional configuration of a decoding device 20 according to Embodiment 3 of the present invention.

As shown in FIG. 13, the decoding device 20 is a device which decodes a coded audio signal coded by the coding device 10, and includes a lossless decoder 201, a dynamic time warping reconstruction unit 202, a time warping unit 203, a transform decoder 204, and a demultiplexer 205.

The demultiplexer 205 demultiplexer the input bitstream into the coded time warping parameter, the transform encoder information, and the coded audio signal.

The bitstream inputted here is the bitstream outputted by the multiplexer 106 of the coding device 10, that is, the bitstream obtained by multiplexing: the coded audio signal; the coded time warping parameter; and the transform encoder information. The coded audio signal is obtained by coding a pitch-corrected audio signal, and the coded time warping parameter is obtained by coding the first time warping parameter for correcting the pitch.

The lossless decoder 201 and the dynamic time warping reconstruction unit 202 are a first decoding unit which decodes the coded time warping parameter to generate a second time warping parameter including information indicating the number of pitch nodes, a pitch change position, and a pitch change ratio. The number of pitch nodes is the number of pitches detected within a period. The pitch change position is a position where a change in pitch occurs in pitches of the number of pitch nodes. The pitch change ratio is a ratio of the change at the pitch change position.

Specifically, the demultiplexer 205 sends the coded time warping parameter to the lossless decoder 201. Then, the lossless decoder 201 decodes the coded time warping parameter and generates a decoded time warping parameter. The decoded time warping parameter includes a flag, information on the position where time warping is applied, and the corresponding time warping values $\Delta p_i$.

Furthermore, the decoded time warping parameter is sent to the dynamic time warping reconstruction unit 202. The dynamic time warping reconstruction unit 202 generates a second time warping parameter from the decoded time warping parameter.

The transform decoder 204 is a second decoding unit which decodes the coded audio signal to generate a pitch-corrected audio signal obtained by correcting pitch to approximate the pitches of the number of pitch nodes to a predetermined reference value.

Specifically, the transform decoder 204 receives the coded audio signal from the demultiplexer 205 based on the transform encoder information. Then, the transform decoder 204 decodes the time-warped coded audio signal.

The time warping unit 203 transforms, using the second time warping parameter, the pitch-corrected audio signal into an audio signal before correction by changing at least one pitch included in the pitches of the number of pitch nodes to restore the pitches of the number of pitches to pitches before correction.

Specifically, the time warping unit 203 receives the second time warping parameter and applies time warping on the input time-warped signals of the right and left channels. The process of time warping is the same as in the time warping unit 104 in Embodiment 1. It is to be noted that a signal is not warped according to the second time warping parameter.

The following describes processing of decoding a coded audio signal performed by the decoding device 20.

Figure 14:
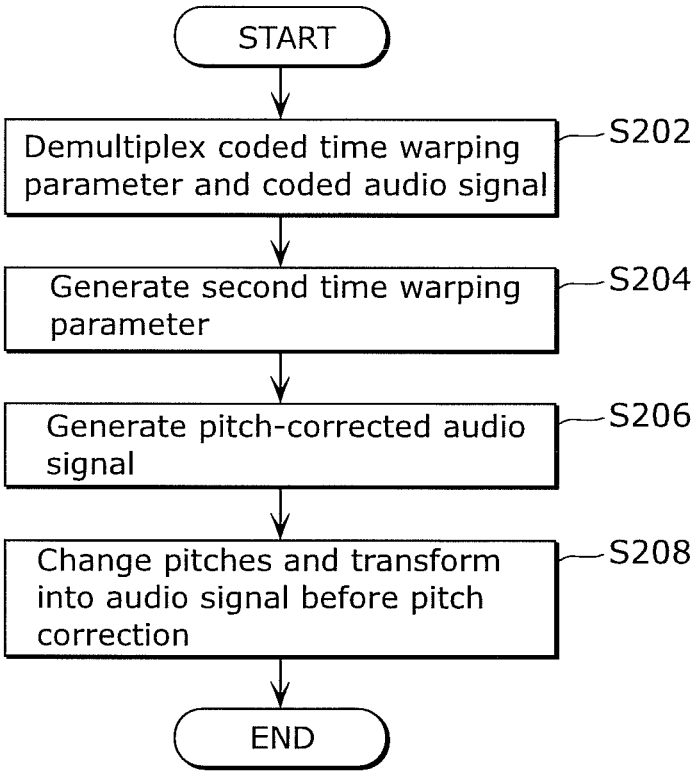
FIG. 14 is a flowchart showing an example of processing of decoding of a coded audio signal performed by the decoding device according to Embodiment 3 of the present invention.

FIG. 14 is a flowchart showing an example of processing of decoding a coded audio signal performed by the decoding device 20 according to Embodiment 3 of the present invention.

As shown in FIG. 14, firstly, the demultiplexer 205 demultiplexes the input bitstream into the coded time warping parameter and the coded audio signal (S202).

Then, the lossless decoder 201 and the dynamic time warping reconstruction unit 202 decode the coded time warping parameter to generate a second time warping parameter including information indicating the number of pitch nodes, a pitch change position, and a pitch change ratio (S204).

The transform decoder 204 decodes the coded audio signal to generate a pitch-corrected audio signal obtained by correcting pitch to approximate the pitches of the number of pitch nodes to a predetermined reference value (S206).

Then, the time warping unit 203 transforms, using the second time warping parameter, the pitch-corrected audio signal into an audio signal before correction by changing at least one pitch included in the pitches of the number of pitch nodes to restore the pitches of the number of pitch nodes to pitches before correction (S208).

With the above, the processing of decoding a coded audio signal performed by the decoding device 20 is finished.

As described above, the decoding device 20 according to Embodiment 3: demultiplexes the coded audio signal and the coded time warping parameter from the bitstream; and decodes the coded time warping parameter to generate a second time warping parameter including information indicating the number of pitch nodes, a pitch change position, and a pitch change ratio. Then, the decoding device 20: decodes the coded audio signal to generate a pitch-corrected audio signal; and transforms, using the second time warping parameter, the audio signal into an audio signal before correction by changing pitch to restore the pitches of the number of pitches to pitches before correction. In this manner, the decoding device 20: decodes the coded time warping parameter to generate a second time warping parameter; and restore the audio signal to an audio signal before pitch shifting by restoring the pitches of the number of pitch nodes into pitches before correction. Therefore, the decoding device 20 can perform decoding without using a large number of bits even when the audio signal to be decoded is with large pitch change. This is because the decoding device 20 uses an extended fixed table which supports a wide range of pitch change ratio and decodes a time warping parameter obtained as a result of reducing the number of bits used when coding an index of the extended fixed table by using lossless variable-length coding such as Huffman coding. Thus, with the decoding device 20, the sound quality can be improved with a small number of bits even when the audio signal is with a large pitch change.

[Embodiment 4]

Details of the lossless encoder and the lossless decoder for encoding or decoding the pitch change ratio are described in Embodiment 4.

The decoded time warping parameter received by the dynamic time warping reconstruction unit 202 includes a flag, information on the position where time warping is applied, and the corresponding time warping values $\Delta p_i$.

First, the dynamic time warping reconstruction unit 202 checks the flag. If the flag indicates 0, it means time warping is not applied to the current frame. In this case, all of the reconstructed pitch contour vectors are set to 1.

If the flag indicates 1, it means M bits are used to code the vector C indicating the positions where time warping is applied. One bit matches one position. When 1 is marked in the vector C, it means there is no pitch change. Meanwhile, when 0 is marked in the vector C, it means there is a pitch change.

Then, by counting how many 0s are in the vector C, the dynamic time warping reconstruction unit 202 recognizes the total number N of pitch change positions. In the following, N time warping values $\Delta p_i$ are obtained from the buffer. $\Delta p_i$ corresponds to the time warping values where c(i)=0. The time warping values $\Delta p_i$ are decoded by the lossless decoder. The pseudo code is as follows:

```
For i = 0:M
        Pitch__ratio[i]=1;
If    flag==1
   For i = 1:M
{
        Read(vector C(i))
        If vector C(i)==0
       {
           Read(ratio);
           Pitch__ratio[i]=ratio;
```

-continued

```
        }
    }
```

The normalized pitch contour is reconstructed as below.

$$pitch_i = pitch_ratio(i) \times pitch_{i-1} \quad \text{[Math 14]}$$

The pitch contour is used for time warping later.

[Embodiment 5]

Figure 15:
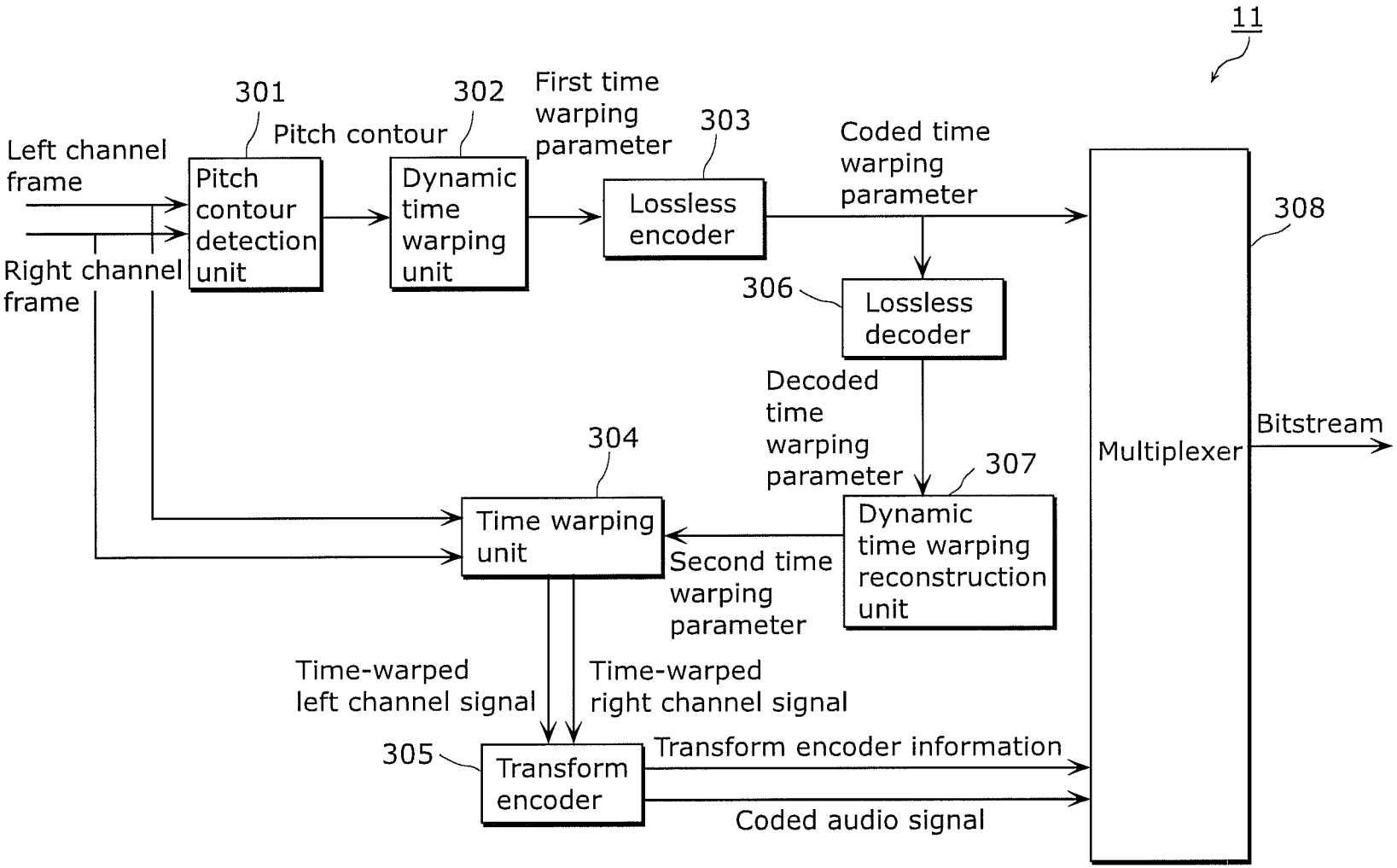
FIG. 15 is a block diagram showing a functional configuration of a coding device according to Embodiment 5 of the present invention.

In Embodiment 5, another coding device applied with the dynamic time warping scheme is proposed. FIG. 15 is a block diagram showing a functional configuration of a coding device 11 according to Embodiment 5 of the present invention.

As shown in FIG. 15, the coding device 11 includes a pitch contour detection unit 301, a dynamic time warping unit 302, a lossless encoder 303, a time warping unit 304, a transform encoder 305, a lossless decoder 306, a dynamic time warping reconstruction unit 307, and a multiplexer 308.

Here, the difference between the coding device 10 in Embodiment 1 shown in FIG. 8 and the coding device 11 in Embodiment 5 is that the coding device 11 includes the lossless decoder 306 and the dynamic time warping reconstruction unit 307. Specifically, in Embodiment 1, the pitch information before coding (quantization) is used for time warping performed by the time warping unit 104, and the pitch information before coding (quantization) may be different from the decoded pitch information in the decoding device 20.

More specifically, (i) the first time warping parameter generated by the dynamic time warping unit 102 and (ii) the second time warping parameter is different, in some cases. The second time warping parameter is generated by decoding the coded time warping parameter performed by the decoding device 20. The coded time warping parameter is obtained by coding the first time warping parameter. Particularly, there is a high possibility that the pitch change ratio included in the first time warping parameter and the pitch change ratio included in the second time warping parameter are different.

In Embodiment 5, to enhance the accuracy of coding, the first time warping parameter is coded first and then decoded by the lossless decoder 306, and the second time warping parameter is reconstructed by the dynamic time warping reconstruction unit 307.

It is to be noted that the function of the lossless decoder 306 is similar to the function of the lossless decoder 201 shown in FIG. 13. Furthermore, the function of the dynamic time warping reconstruction unit 307 is similar to the function of the dynamic time warping reconstruction unit 202 shown in FIG. 13.

Specifically, the lossless decoder 306 and the dynamic time warping reconstruction unit 307 are a decoding unit which decodes the coded time warping parameter generated by the lossless encoder 303 to generate a second time warping parameter including information indicating the number of pitch nodes, a pitch change position, and a pitch change ratio in a pitch contour within a period.

Then, the time warping unit 304 corrects pitch using the second time warping parameter generated by the lossless decoder 306 and the dynamic time warping reconstruction unit 307.

In this manner, the coding device 11 can use exactly the same time warping parameter as used by the decoding device 20.

It is to be noted that each of the pitch contour detection unit 301, the dynamic time warping unit 302, the lossless encoder 303, the time warping unit 304, the transform encoder 305, and the multiplexer 308 of the coding device 11 in Embodiment 5 has the function similar to the function of the pitch contour detection unit 101, the dynamic time warping unit 102, the lossless encoder 103, the time warping unit 104, the transform encoder 105, and the multiplexer 106 of the coding device 10 in Embodiment 1. Therefore, detailed description is omitted.

As described above, with the coding device 11 according to Embodiment 5, the generated coded time warping parameter is decoded to generate a second time warping parameter including information indicating the number of pitch nodes, the pitch change position, and the pitch change ratio, and pitch is corrected using the generated second time warping parameter. Specifically, the coding device 11 performs pitch shifting by using not the first time warping parameter but the second time warping parameter. The second time warping parameter is generated by decoding the coded time warping parameter obtained by coding the first time warping parameter. Here, the second time warping parameter is a parameter to be used when the audio signal is decoded by the decoding device 20. Therefore, with the coding device 11, calculation accuracy in time decompressing processing for decoding can be improved by performing pitch shifting using the same parameter as the parameter used by the decoding device. Thus, with the coding device 11, the sound quality can be improved with a small number of bits by performing coding with high accuracy even when the audio signal is with a large pitch change.

[Embodiment 6]

Figure 16:
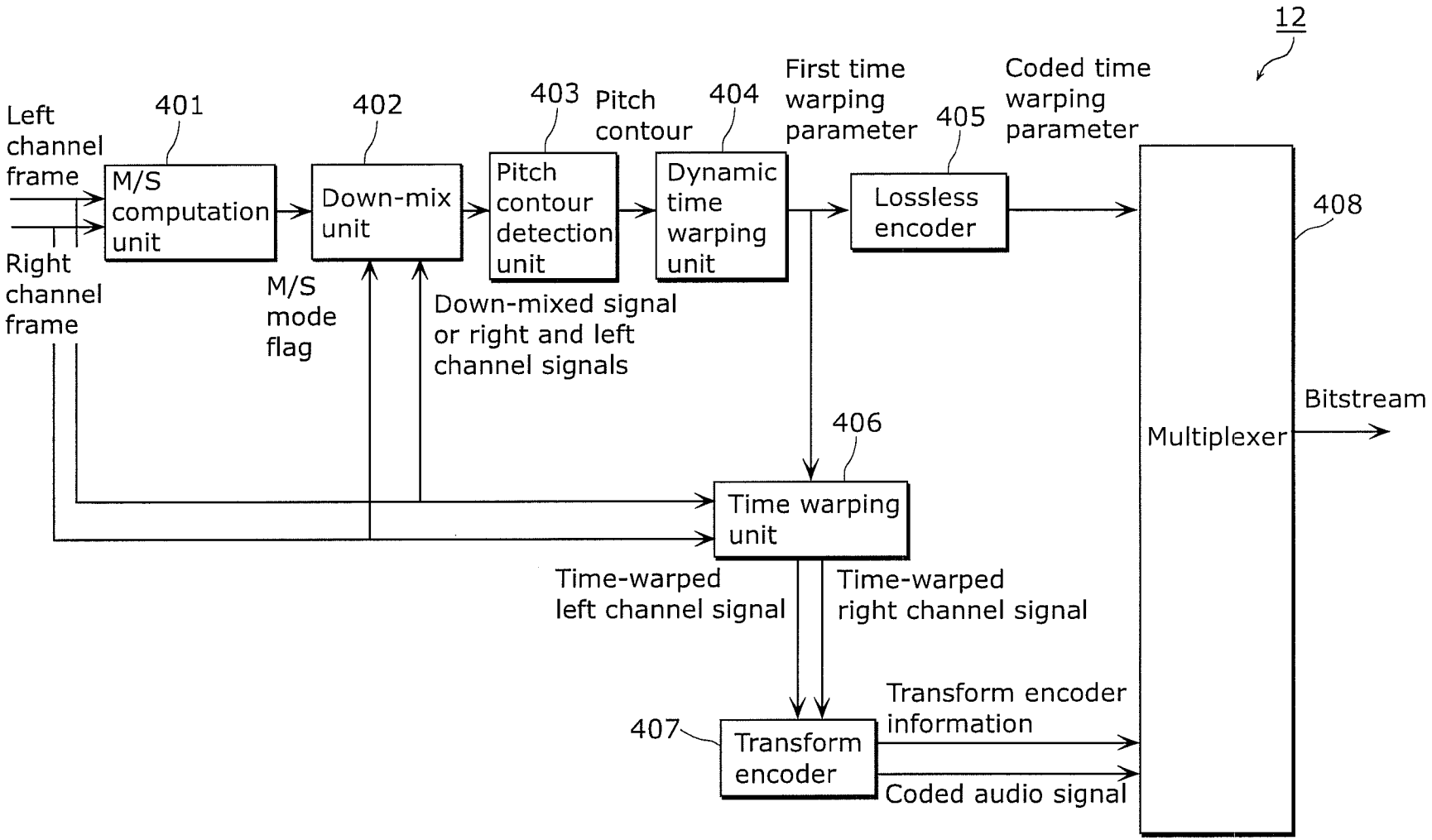
FIG. 16 is a block diagram showing a functional configuration of a coding device according to Embodiment 6 of the present invention.

In Embodiment 6, a coding device is introduced in which a main and side (M/S) mode is integrated. FIG. 16 is a block diagram showing a functional configuration of a coding device 12 according to Embodiment 6 of the present invention.

The M/S mode is often used for stereo signals, for example AAC codec, from among many codecs. The M/S mode is used to detect the similarity of a sub-band of the right channel and a sub-band of the left channel, based on the sub-band of a frequency domain. When the sub-bands of the right and left channels are similar, the M/S mode is activated. When the sub-bands of the right and left channels are not similar, the M/S mode is not activated.

Since M/S mode information is available for most of the transform coding, in the dynamic time warping scheme, the M/S mode information can be used to improve the performance of harmonic time warping.

More specifically, as shown in FIG. 16, the coding device 12 includes an M/S computation unit 401, a down-mix unit 402, a pitch contour detection unit 403, a dynamic time warping unit 404, a lossless encoder 405, a time warping unit 406, a transform encoder 407, and a multiplexer 408.

It is to be noted that each of the pitch contour detection unit 403, the dynamic time warping unit 404, the lossless encoder 405, the time warping unit 406, the transform encoder 407, and the multiplexer 408 has the function similar to the function of the pitch contour detection unit 101, the dynamic time warping unit 102, the lossless encoder 103, the time warping unit 104, the transform encoder 105, and the multiplexer 106 of the coding device 10 in Embodiment 1. Therefore, detailed description is omitted.

The M/S computation unit 401 calculates a similarity level of pitch contours of the signals of the two channels of the input audio signal to generate a flag indicating whether or not the calculated similarity level is greater than a predetermined value.

More specifically, the signals of the right and left channels are sent to the M/S computation unit 401. Then, the M/S computation unit 401 calculates the similarity of the signals of the right and left signals of the frequency domain. This is the same as the detection in the M/S mode in transform coding. Then, the M/S computation unit 401 generates one flag. Specifically, when the M/S mode is activated for all the sub-bands of the stereo signal, the M/S computation unit 401 sets the flag to 1. Otherwise, the flag is set to 0.

Furthermore, if the flag generated by the M/S computation unit 401 indicates that the similarity level is greater than the predetermined value, the down-mix unit 402 outputs one signal obtained by down-mixing the signals of the two channels. If the flag indicates that the similarity level is less than or equal to the predetermined value, the down-mix unit 402 outputs the signals of the two channels.

More specifically, if the flag=1, the down-mix unit 402 down-mixes the right and left signals into a main signal and a side signal. The main signal is sent to the pitch contour detection unit 403. If the flag≠1, the down-mix unit 402 sends the original stereo signal to the pitch contour detection unit 403.

Then, the pitch contour detection unit 403 detects a pitch contour of each of the signals outputted by the down-mix unit 402.

More specifically, the pitch contour detection unit 403 receives one of the original stereo signal and the down-mixed stereo signal. When the down-mixed signal is received, the pitch contour detection unit 403 detects one set of pitch contours. When the down-mixed signal is not received, the pitch contour detection unit 403 detects each of the pitch contour of the right audio signal and the pitch contour of the left audio signal.

In this manner, in Embodiment 6, the dynamic time warping scheme can be modified to be more suitable for stereo signal coding. In stereo signal coding, the right and left channels may have different characteristics from each other. In this case, a different first time warping parameter is calculated for each of the different channels. The right and left channels have similar characteristics in some cases. In this case, it is reasonable to use the same first time warping parameter for both of the channels. Specifically, it is more efficient to use the same first time warping parameter when the right and left channels have similar characteristics.

As described above, the coding device 12 according to Embodiment 6: calculates a similarity level of pitch contours of the signals of the two channels which are the input audio signals; outputs one signal obtained by down-mixing the signals of the two channels when the similarity level is greater than the predetermined value; and outputs the signals of the two channels when the similarity level is less than or equal to the predetermined value. Specifically, when the similarity level of pitch contours of the signals of the two channels is high, the coding device 12 generates one second time warping parameter common to the signals of the two channels based on the pitch contour of one of the signals. In this manner, with the coding device 12, it is sufficient to code one second time warping parameter to code signals of two channels, which reduces the number of bits to be used. Therefore, with the coding device 12, the sound quality can be improved with a small number of bits even when the audio signal is with a large pitch change.

[Embodiment 7]

Figure 17:
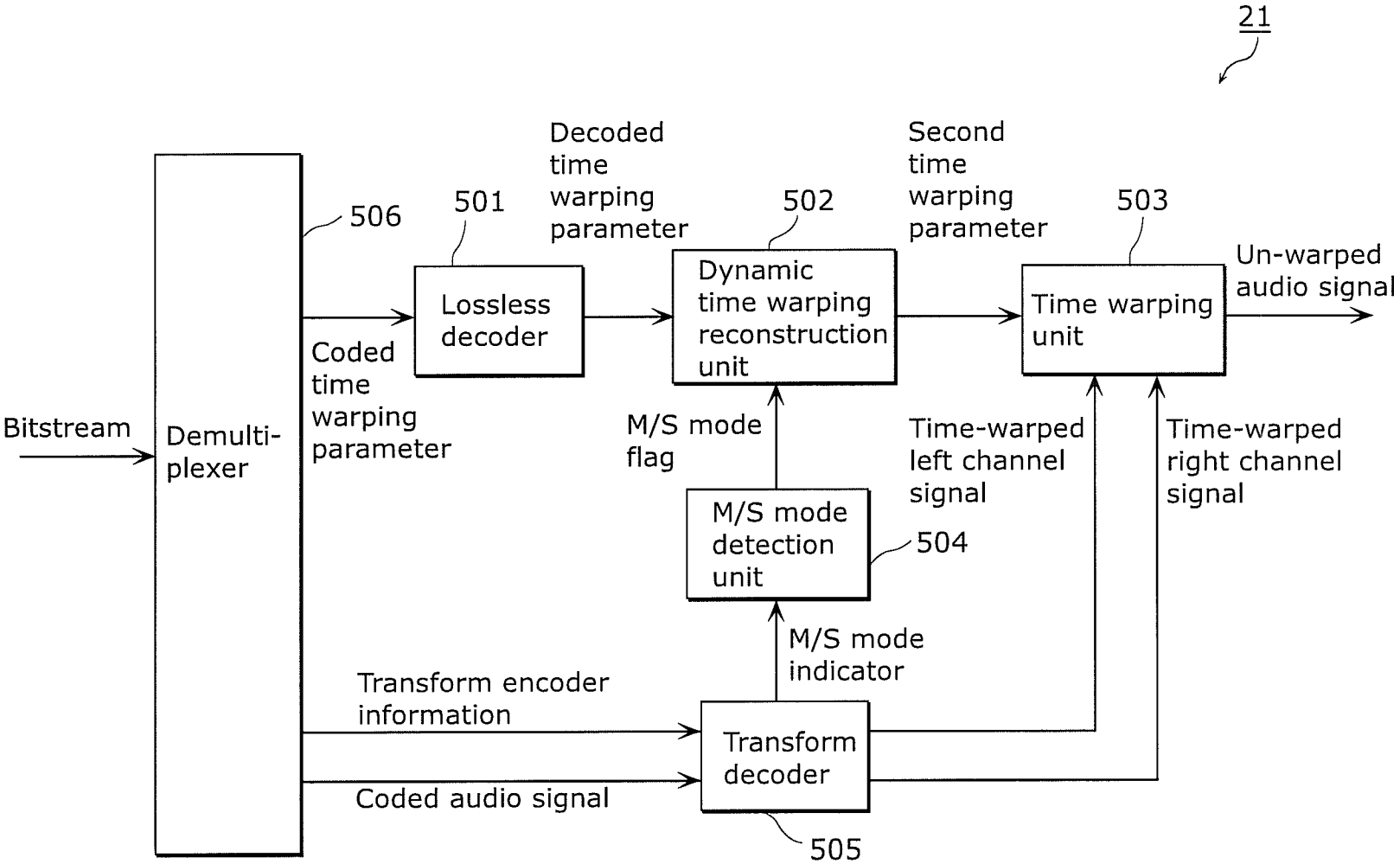
FIG. 17 is a block diagram showing a functional configuration of a decoding device according to Embodiment 7 of the present invention.

In Embodiment 7, a decoding device which supports the M/S mode is introduced. FIG. 17 is a block diagram showing a functional configuration of the decoding device 21 according to Embodiment 7 of the present invention.

As shown in FIG. 17, the decoding device 21 includes a lossless decoder 501, a dynamic time warping reconstruction unit 502, a time warping unit 503, an M/S mode detection unit 504, a transform decoder 505, and a demultiplexer 506.

Here, the lossless decoder 501, the dynamic time warping reconstruction unit 502, the time warping unit 503, the transform decoder 505, and the demultiplexer 506 of the decoding device 21 has the function similar to the function of the lossless decoder 201, the dynamic time warping reconstruction unit 202, the time warping unit 203, the transform decoder 204, and the demultiplexer 205 of the decoding device 20 in Embodiment 3. Therefore, detailed description is omitted.

First, the input bitstream is sent to the demultiplexer 506. Then, the demultiplexer 506 outputs the coded time warping parameter, the transform encoder information, and the coded audio signal.

Then, the transform decoder 505 decodes the coded audio signal into a time-warped signal in accordance with the transform encoder information, and extracts the M/S mode information. Then, the transform decoder 505 sends the extracted M/S mode information to the M/S mode detection unit 504.

The M/S mode detection unit 504 generates a flag indicating whether or not the similarity level of pitch contours of the signals of the two channels which are the input audio signals is greater than a predetermined value.

More specifically, the M/S mode detection unit 504 sets the flag to 1, allowing the M/S mode to be also activated for time warping when the M/S mode is activated for all sub-bands for this frame. Otherwise, the M/S mode detection unit 504 sets the flag to 0 since the M/S mode is not used in the harmonic time warping reconstruction. Then, the M/S mode detection unit 504 sends the M/S mode flag to the dynamic time warping reconstruction unit 502.

When the flag generated by the M/S mode detection unit 504 indicates that the similarity level is greater than the predetermined value, the dynamic time warping reconstruction unit 502 generates the second time warping parameter common to the signals of the two channels. When the flag indicates that the similarity level is less than or equal to the predetermined value, the dynamic time warping reconstruction unit 502 generates the second time warping parameter for each of the signals of the two channels.

More specifically, the dynamic time warping reconstruction unit 502 reconstructs the decoded time warping parameter inverse-quantized by the lossless decoder 501 into the second time warping parameter.

Specifically, if the flag=1, the dynamic time warping reconstruction unit 502 generates one set of second time warping parameters, while generating two sets of second time warping parameters if the flag≠1. The process of generating a second time warping parameter is the same as the process of generating a first time warping parameter performed by the dynamic time warping unit 102 in Embodiment 2.

If the flag=1, the time warping unit 503 applies the same second time warping parameter to the time-warped stereo signal. If the flag≠1, the time warping unit 503 applies different second time warping parameter to the time-warped left signal and the time-warped right signals.

As described above, the decoding device 21 according to Embodiment 7: generates the second time warping parameter common to the signals of the two channels which are the input audio signals when the similarity level of pitch contours of the signals of the two channels is greater than the predetermined value; and generates the second time warping parameter for each of the signals of the two channels when the similarity level is less than or equal to the predetermined value. Specifically, when the similarity level of pitch contours of the signals of the two channels is high, the decoding device 21 generates one second time warping parameter. In this manner, with the decoding device 21, the number of bits to be used can be reduced since it is sufficient to use only one second time warping parameter to decode the signals of the two channels. Therefore, with the coding device 21, the sound quality can be improved with a small number of bits even when the audio signal is with a large pitch change.

[Embodiment 8]

Figure 18:
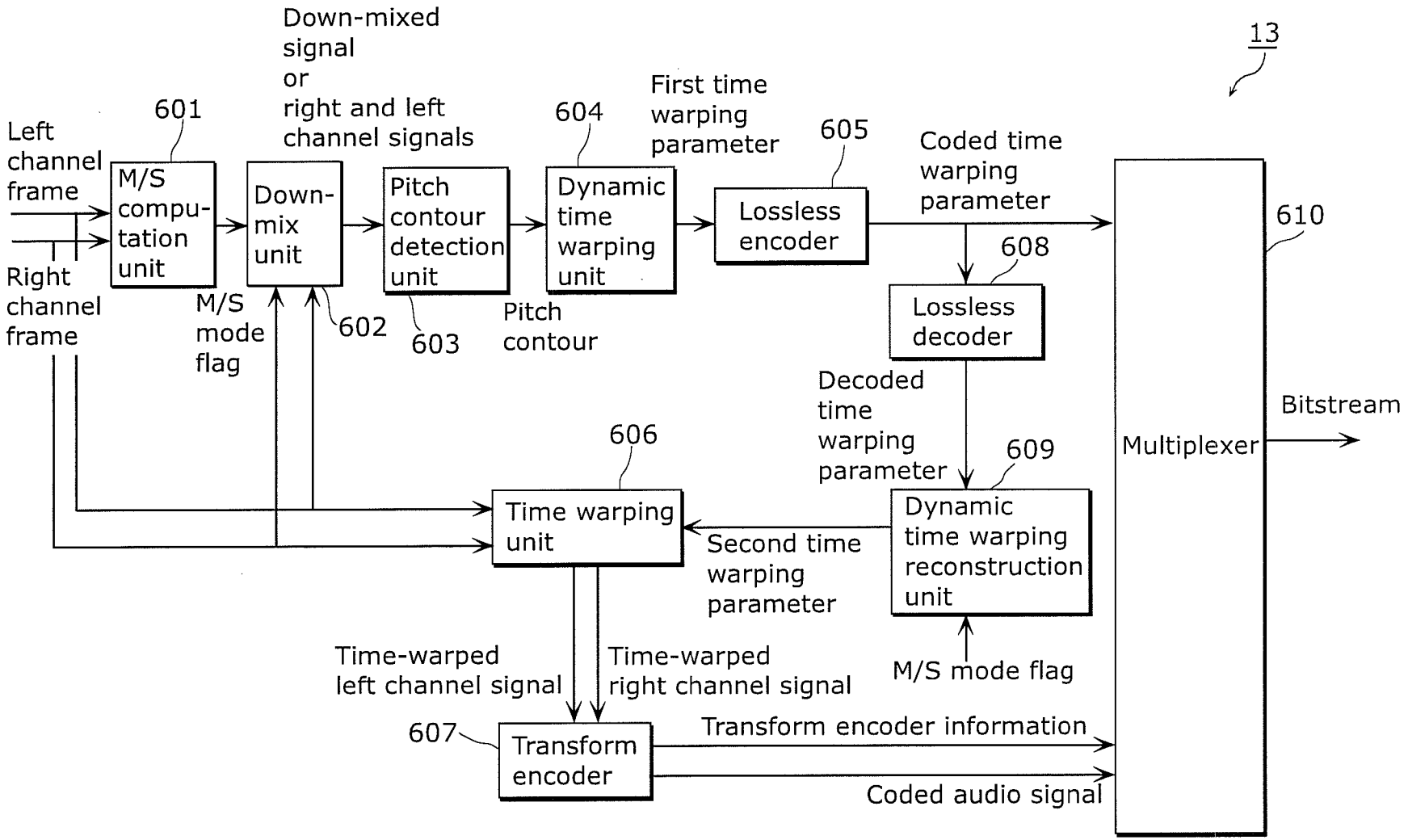
FIG. 18 is a block diagram showing a functional configuration of a coding device according to Embodiment 8 of the present invention.

In Embodiment 8, Embodiment 6 is modified to increase the accuracy of time warping in the decoding device. The modification point is the same as the modification in Embodiment 5. FIG. 18 is a block diagram showing a functional configuration of a coding device 13 according to Embodiment 8 of the present invention.

As shown in FIG. 18, the coding device 13 includes an M/S computation unit 601, a down-mix unit 602, a pitch contour detection unit 603, a dynamic time warping unit 604, a lossless encoder 605, a time warping unit 606, a transform encoder 607, a lossless decoder 608, a dynamic time warping reconstruction unit 609, and a multiplexer 610.

Here, each of the M/S computation unit 601, the down-mix unit 602, the pitch contour detection unit 603, the dynamic time warping unit 604, the lossless encoder 605, the time warping unit 606, the transform encoder 607, and the multiplexer 610 has the function similar to the function of the M/S computation unit 401, the down-mix unit 402, the pitch contour detection unit 403, the dynamic time warping unit 404, the lossless encoder 405, the time warping unit 406, the transform encoder 407, and the multiplexer 408 of the coding device 12 in Embodiment 6. Therefore, detailed description is omitted.

Specifically, in Embodiment 8, the lossless decoder 608 and the dynamic time warping reconstruction unit 609 are added to the structure of Embodiment 6. The purpose is to allow the coding device to use the same second time warping parameter as the decoding device, as in Embodiment 5.

It is to be noted that the faction of the lossless decoder 608 and the dynamic time warping reconstruction unit 609 are similar to the function of the lossless decoder 501 and the dynamic time warping reconstruction unit 502 of the decoding device 21 in Embodiment 7. Therefore, detailed description is omitted.

[Embodiment 9]

Figure 19:
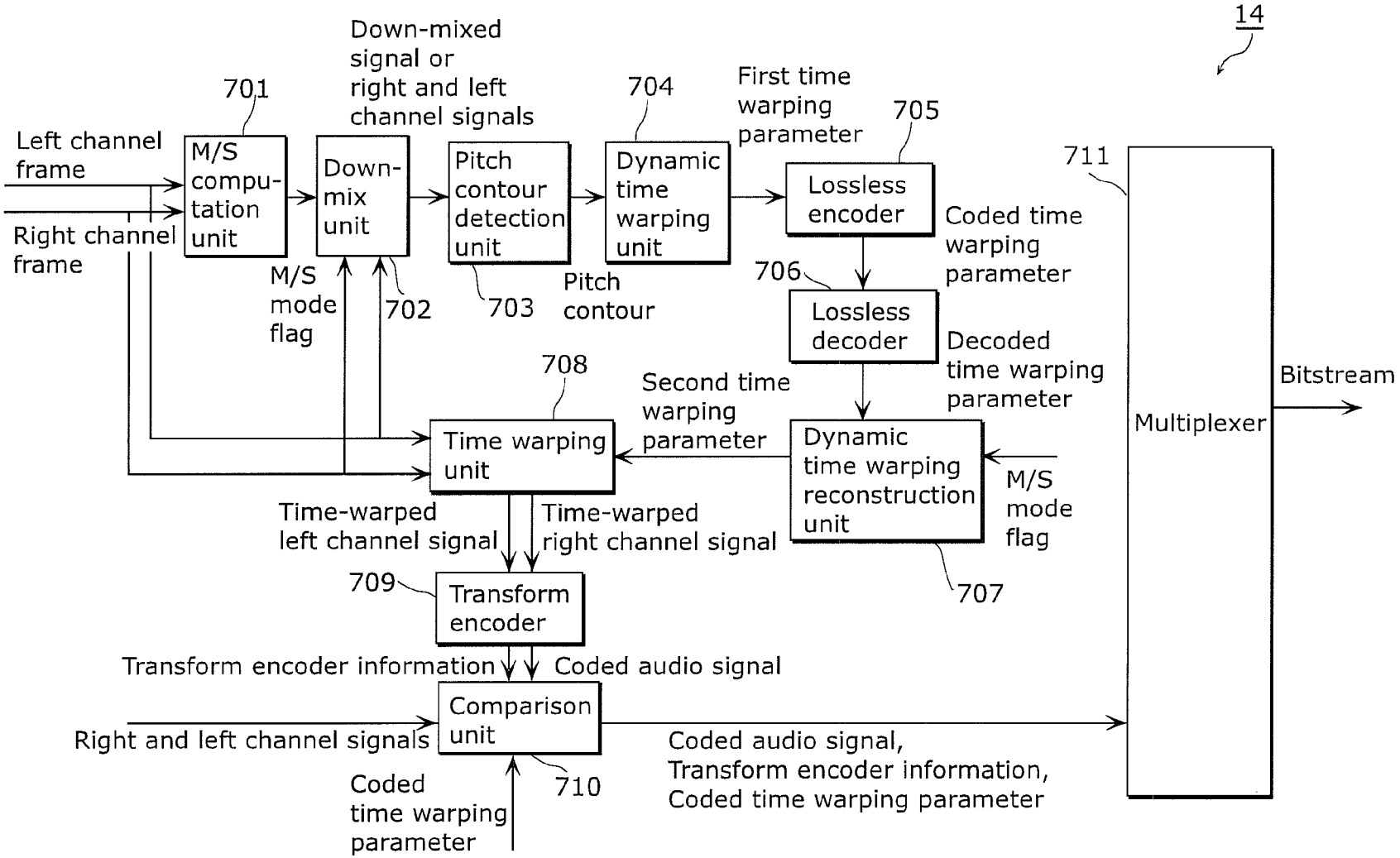
FIG. 19 is a block diagram showing a functional configuration of a coding device according to Embodiment 9 of the present invention.

In Embodiment 9, a coding device applied with a closed-loop dynamic time warping scheme is introduced. FIG. 19 is a block diagram showing a functional configuration of a coding device 14 according to Embodiment 9 of the present invention.

As shown in FIG. 19, the coding device 14 includes an M/S computation unit 701, a down-mix unit 702, a pitch contour detection unit 703, a dynamic time warping unit 704, a lossless encoder 705, a lossless decoder 706, a dynamic time warping reconstruction unit 707, a time warping unit 708, a transform encoder 709, a comparison unit 710, and a multiplexer 711.

It is to be noted that although the structure of Embodiment 9 is based on the structure of Embodiment 8, a comparison scheme is added. Specifically, the coding device 14 has a configuration in which the comparison unit 710 is added to the configuration of the coding device 13 in Embodiment 8. Therefore, detailed description on the configuration of the coding device 14 is omitted except for the comparison unit 710.

The comparison unit 710 compares a first coded signal with a second coded signal. The first coded signal is the coded audio signal generated by the transform encoder 709. The second coded signal is obtained by coding the input audio signal through another coding scheme.

Specifically, the comparison unit 710 checks the coded audio signal before sending the coded audio signal and the coded time warping parameter to the multiplexer 711. More specifically, the comparison unit 710 judges whether or not the sound quality is improved overall after decoding time warping.

More specifically, the comparison unit 710 decodes the first coded signal using the coded time warping parameter generated by the lossless encoder 705 to calculate a first difference that is a difference between the input audio signal and the decoded first coded signal. Furthermore, the comparison unit 710 decodes the second coded signal to calculate a second difference that is a difference between the input audio signal and the decoded second coded signal. Then, the comparison unit 710 outputs the first coded signal when the first difference is less than the second difference.

Here, the comparison unit 710 can perform comparison through various kinds of comparison schemes. One example is to compare the signal-noise ratio (SNR) of the decoded signal with the SNR of the original signal.

First, the comparison unit 710 decodes the time-warped coded audio signal by the transform decoder. For example, the comparison unit 710 applies time warping to the decoded audio signal, using the second time warping parameter as in the time warping unit 708. Then, the comparison unit 710 calculates $SNR_1$ by comparing the un-warped audio signal with the original audio signal.

Next, the comparison unit 710 generates another coded audio signal without applying time warping. Then, the comparison unit 710 decodes this coded audio signal by the same transform decoder and calculates $SNR_2$ by comparing the decoded audio signal with the original audio signal.

Next, the comparison unit 710 makes a determination by comparing $SNR_1$ with $SNR_2$. If $SNR_1 > SNR_2$, the comparison unit 710 selects time warping, and sends the first coded signal, the transform encoder information, and the coded time warping parameter to the multiplexer 711.

Then, the multiplexer 711 multiplexes the first coded signal, the transform encoder information, and the coded time warping parameter outputted by the comparison unit 710, to generate a bitstream.

Furthermore, If $SNR_1 < SNR_2$, the comparison unit 710 does not select time warping, and sends the second coded signal and the transform encoder information to the multiplexer 711.

As another comparison scheme, the comparison unit 710 may compare the number of bits to be used instead of SNR.

In this manner, with the present dynamic time warping scheme, the effectiveness of time warping is also evaluated by comparing the harmonic structure before and after time warping, and a determination is made on whether time warping should be adopted for the current frame. Thus, an error caused by the inaccurate pitch contour is reduced.

As described above, the coding device 14 according to Embodiment 9: compares a first coded signal with a second coded signal, the first coded signal being the generated coded audio signal, the second coded signal being obtained by coding the input audio signal through another coding scheme; and outputs the first coded signal when the difference between the input audio signal and the decoded first coded signal is less than the difference between the input audio signal and the decoded second coded signal. Specifically, the coding device 14 outputs the generated coded audio signal only when the coding is performed with high accuracy. Thus, with the encoding device 14, the sound quality can be improved with a small number of bits by performing coding with high accuracy even when the audio signal is with a large pitch change.

[Embodiment 10]

In Embodiment 10, a scheme is proposed for making the length of the pitch information variable in a dynamic time warping scheme.

The structure of a coding device in Embodiment 10 is the same as the structure of the coding device 11 in Embodiment 5, for example. It is to be noted that the structure of the coding device in Embodiment 10 may be the same as the structure in other embodiments above.

The dynamic time warping unit 302 of the coding device 11 in Embodiment 10 analyzes the detected pitch contour to decide the optimal number of pitch nodes. Therefore, the number of pitch nodes is variable. A length indicator is used to indicate the number of pitch nodes. The table below illustrates the length indicator of the number of pitch nodes.

TABLE 1

| Indicator | Number of nodes (M) |
|---|---|
| 0 | $M_0$ node |
| 1 | $M_1$ node |
| 2 | $M_2$ nodes |
| 3 | $M_3$ nodes |
| . . . | . . . |
| N − 1 | $M_{N-1}$ nodes |

The length indicator of the number of pitch nodes is coded using $\log_2 N$ bits. The number-of-pitch-nodes M can be flexible according to the bit-rate of the codec, for example, M=16 for 64 kbps, while M=8 or 2 for 24 kbps. Furthermore, the number-of-pitch-nodes M can also be variable according to other parameters generated by the codec, such as a window size. For example, M=8 for a long window frame, while M=4 for a short window frame.

Furthermore, an example of the length indicator of the number of pitch nodes is shown in the table below.

TABLE 2

| Indicator | Number of nodes (M) |
|---|---|
| 0 (00) | 0 node |
| 1 (01) | 2 nodes |
| 2 (10) | 8 nodes |
| 3 (11) | 16 nodes |

In this case, 2 bits are used to code the length indicator. If there is 0 node at a pitch change position, time warping is not performed, and no further time warping parameter is coded. Meanwhile, if there are M nodes at the pitch change position, M bits are used to code a pitch change status of each position defined as the vector C. Here, M can be 16, 8, and 2. As shown in FIG. 12, one bit matches one position. If there is no pitch change at a position i, C[i] is set to 1. If there is a pitch change at the position i, C[i] is set to 0 to indicate that pitch change has happened at the position i.

The pitch change value $\Delta p_i$ at each node where C[i] is equal to 0 is coded by the lossless encoder 303.

Then, the lossless encoder 303 sends, to the multiplexor 308, the coded length indicator indicating the number of pitch nodes, the vector C indicating the pitch change position, and the pitch change ratio.

In this manner, with the scheme proposed in Embodiment 10, coding with dynamic time warping is further optimized by using the length indicator indicating the variable length of pitch nodes.

Specifically, in the prior arts, a fixed number of pitch values are calculated out of one frame. Here, as a result of the inventors' earnest research, it is found that the pitch change does not occur frequently in a short time period. Therefore, it is more efficient to have the number of pitches according to the characteristics of the signal. Thus, the sound quality can be improved with further more saved bits.

[Embodiment 11]

In Embodiment 11, a decoding device applied with a scheme for decoding a variable length of time warping parameter is proposed. For example, the decoding device 20 shown in FIG. 13 can be used as an example of the decoding device in Embodiment 11.

In Embodiment 11, the decoding length of the time warping nodes is variable. This corresponds to the coding device described in Embodiment 10. The following describes an example of the decoding device in Embodiment 11.

After the bitstream is demultiplexed, the decoding device 20 in Embodiment 11 sends the coded time warping parameter to the lossless decoder 201. According to Embodiment 10, the length indicator is coded by $\log_2 N$ bits. The lossless decoder 201 decodes the number-of-pitch-nodes M using the table of the length indicator of the number of pitch nodes in Embodiment 10.

Here, the number-of-pitch-nodes M can be different according to the bit-rate of the codec. For example, M=16 for 64 kbps, while M=8 or 2 for 24 kbps. Furthermore, the number-of-pitch-nodes M can also be variable depending on other parameters generated by the codec, such as a window size. For example, M=8 for a long window frame, M=4 for a short window frame.

An example of a decoding scheme for a length indicator is shown in the table below.

TABLE 3

| Indicator | Number of nodes (M) |
|---|---|
| 0 (00) | 0 node |
| 1 (01) | 2 nodes |
| 2 (10) | 8 nodes |
| 3 (11) | 16 nodes |

If there is 0 node at the pitch change position, time warping is not performed, and no further time warping parameter is coded.

If there are M nodes at the pitch change position, M bits of pitch change position vector C are decoded. Here, M can be 16, 8, and 2. One bit matches one position. When C[i] is equal to 1, it means there is no pitch change at the position i. When C[i] is equal to 0, it means there is a pitch change at the position i, as illustrated in FIG. 12.

The lossless decoder 201 decodes the pitch change value $\Delta p$; at the position where the vector C[i] is equal to 0.

The pseudo code is described as below.

```
M=Table_Indicator[Reads(indicator)];
For i=0:M
        Pitch_ratio[i]=1;
If (M>0)
    For i=0:M
   {
          Read(vector C(i))
          If (vector C(i)==0)
         {
             Pitch_ratio[i]=Lossless_dec(Read(ratio index));
             }
}
```

The normalized pitch contour is reconstructed as below.

$$pitch_i = pitch_ratio(i) \times pitch_{i-1} \quad \text{[Math 15]}$$

The pitch contour is used in the time warping unit 203 which shifts the pitch of the time-warped audio signal.

The coding device and the decoding device according to the present invention have been described based on the embodiments, however, the present invention is not limited to these embodiments. In other words, the embodiments disclosed here should be considered not as limitary but as exemplary in all respects. The scope of the present invention is indicated not by the above description but by the scope of claims, and it is intended that meanings equal to the scope of claims and all changes within the scope of claims are included in the scope of the present invention.

Furthermore, the present invention can be implemented not only as a coding device or a decoding device as described above, but also as a coding method or a decoding method including characteristic processing performed by processing units included in the coding device or the decoding device as steps. Furthermore, the present invention can be implemented as a program causing a computer to execute the characteristic processing included in the coding device or the decoding device. Furthermore, such a program can be distributed via a recording medium such as a CD-ROM or the like or a transmission medium such as the Internet.

Furthermore, each functional block of the coding device shown in the block diagram in FIG. 8, 15, 16, or 18, and the decoding device shown in the block diagram in FIG. 13 or 17 may be implemented as an LSI that is an integrated circuit. These may be integrated into one chip separately, or may be integrated into one chip to include part or all of the constituents.

The LSI introduced here may be referred to as an integrated circuit (IC), a system LSI, a super LSI, or an ultra LSI, depending on integration density.

Furthermore, the technique of integration is not limited to the LSI, and it may be achieved as a dedicated circuit or a general-purpose processor. It is also possible to use a field programmable gate array (FPGA) that can be programmed after manufacturing the LSI, or a reconfigurable processor in which connection and setting of circuit cells inside the LSI can be reconfigured.

Furthermore, with appearance of an integration technology which replaces the LSI brought by advancement in the semiconductor technology or another technology derived therefrom, the technology may be used to integrate functional blocks. Application of biotechnology is one such possibilities.

INDUSTRIAL APPLICABILITY

With the present invention, the sound quality can be improved with a small number of bits even when the audio signal is with a large pitch change.

REFERENCE SIGNS LISTS

10, 11, 12, 13, 14 Image coding device
20, 21 Image decoding device
101, 301, 403, 603, 703 Pitch contour detection unit
102, 302, 404, 604, 704 Dynamic time warping unit
103, 303, 405, 605, 705 Lossless encoder
104, 304, 406, 606, 708 Time warping unit
105, 305, 407, 607, 709 Transform encoder
106, 308, 408, 610, 711 Multiplexer
201, 501 Lossless decoder
202, 502 Dynamic time warping reconstruction unit
203, 503 Time warping unit
204, 505 Transform decoder
205, 506 Demultiplexer
306, 608, 706 Lossless decoder
307, 609, 707 Dynamic time warping reconstruction unit
401, 601, 701 M/S computation unit
402, 602, 702 Down-mix unit
504 M/S mode detection unit
710 Comparison unit

The invention claimed is:

1. A coding device comprising:

a pitch contour detection unit configured to detect a pitch contour that is information indicating a change in pitch of an input audio signal within a period;

a dynamic time warping unit configured to: analyze the detected pitch contour; and determine, based on a result of the analysis, the number of pitch nodes that is an optimal number of pitches detected within the period; and generate a first time warping parameter including information indicating the determined number of pitch nodes, a pitch change position, and a pitch change ratio, the pitch change position being a position where the change in pitch occurs in pitches of the number of pitch nodes, the pitch change ratio being a ratio of the change in pitch at the pitch change position;

a first encoder which codes the generated first time warping parameter to generate a coded time warping parameter;

a time warping unit configured to correct, using the information obtained from the generated first time warping parameter, at least one pitch included in the pitches of the number of pitch nodes, to approximate the pitches of the number of pitch nodes to a predetermined reference value;

a second encoder which codes the input audio signal at the pitch corrected by the time warping unit to generate a coded audio signal; and a multiplexer which multiplexes the coded time warping parameter generated by the first encoder and the coded audio signal generated by the second encoder to generate a bitstream.

2. The coding device according to claim 1, further comprising a decoding unit configured to decode the coded time warping parameter generated by the first encoder to generate a second time warping parameter including information indicating the number of pitch nodes, the pitch change position, and the pitch change ratio in the pitch contour within the period, wherein the time warping unit is configured to correct the pitches using the second time warping parameter generated by the decoding unit.

3. The coding device according to claim 1, wherein the input audio signal includes signals of two channels, the coding device further comprises:

a main/side (M/S) computation unit configured to calculate a similarity level of pitch contours of the signals of the two channels to generate a flag indicating whether or not the calculated similarity level is greater than a predetermined value; and a down-mix unit configured to: output one signal obtained by down-mixing the signals of the two channels when the generated flag indicates that the similarity level is greater than the predetermined value; and output the signals of the two channels when the flag indicates that the similarity level is less than or equal to the predetermined value, and the pitch contour detection unit is configured to detect the pitch contour for each of the signals outputted by the down-mix unit.

4. The coding device according to claim 1, further comprising a comparison unit configured to compare a first coded signal with a second coded signal, the first coded signal being the coded audio signal generated by the second encoder, the second coded signal being obtained by coding the input audio signal through another coding scheme, wherein the comparison unit is configured to:

decode the first coded signal using the coded time warping parameter generated by the first encoder to calculate a first difference that is a difference between the input audio signal and the decoded first coded signal;

decode the second coded signal to calculate a second difference that is a difference between the input audio signal and the decoded second coded signal; and output the first coded signal when the first difference is less than the second difference, and the multiplexer multiplexes the first coded signal outputted by the comparison unit and the coded time warping parameter to generate the bitstream.

5. A decoding device comprising:

a demultiplexer which demultiplexes a coded audio signal and a coded time warping parameter from a bitstream, the coded audio signal being obtained by coding a pitch-corrected audio signal, the coded time warping parameter being obtained by coding a first time warping parameter for correcting pitches, the bitstream being obtained by multiplexing the coded audio signal and the coded time warping parameter;

a first decoding unit configured to decode the coded time warping parameter to generate a second time warping parameter including information indicating the number of pitch nodes, a pitch change position, and a pitch change ratio, the number of pitch nodes being the number of pitches detected within a period, the pitch change position being a position where a change in pitch occurs in pitches of the number of pitch nodes, the pitch change ratio being a ratio of the change at the pitch change position;

a second decoding unit configured to decode the coded audio signal to generate a pitch-corrected audio signal obtained by correcting pitch to approximate the pitches of the number of pitch nodes to a predetermined reference value; and a time warping unit configured to transform, using the second time warping parameter, the pitch-corrected audio signal into an audio signal before correction by changing at least one pitch included in the pitches of the number of pitch nodes to restore the pitches of the number of pitch nodes to pitches before correction.

6. The decoding device according to claim 5, wherein the audio signal includes signals of two channels, the decoding device further comprises an M/S mode detection unit configured to generate a flag indicating whether or not a similarity level of pitch contours of the signals of the two channels is greater than a predetermined value, and the first decoding unit is configured to: generate the second time warping parameter common to the signals of the two channels when the generated flag indicates that the similarity level is greater than the predetermined value; and to generate the second time warping parameter for each of the signals of the two channels when the generated flag indicates that the similarity level is less than or equal to the predetermined value.

7. A coding method comprising:

detecting a pitch contour of an input audio signal, the pitch contour being information indicating a change in pitch within a period;

analyzing the detected pitch contour; and determining, based on a result of the analyzing, the number of pitch nodes that is an optimal number of pitches detected within the period, to generate a first time warping parameter including information indicating the determined number of pitch nodes, a pitch change position, and a pitch change ratio, the pitch change position being a position where the change in pitch occurs in pitches of the number of pitch nodes, the pitch change ratio being a ratio of the change at the pitch change position;

coding the generated first time warping parameter to generate a coded time warping parameter;

correcting, using the information obtained from the generated first time warping parameter, at least one pitch included in the pitches of the number of pitch nodes, to approximate the pitches of the number of pitch nodes to a predetermined reference value;

coding the input audio signal having the pitch corrected in the correcting to generate a coded audio signal; and multiplexing the coded time warping parameter generated in the coding of the generated first time warping parameter and the coded audio signal generated in the coding of the input audio signal, to generate a bitstream.

8. A decoding method comprising:

demultiplexing a coded audio signal and a coded time warping parameter from a bitstream, the coded audio signal being obtained by coding a pitch-corrected audio signal, the coded time warping parameter being obtained by coding a first time warping parameter for correcting pitches, the bitstream being obtained by multiplexing the coded audio signal and the coded time warping parameter;

decoding the coded time warping parameter to generate a second time warping parameter including information indicating the number of pitch nodes, a pitch change position, and a pitch change ratio, the number of pitch nodes being the number of pitches detected within a period, the pitch change position being a position where a change in pitch occurs in pitches of the number of pitch nodes, the pitch change ratio being a ratio of the change at the pitch change position;

decoding the coded audio signal to generate a pitch-corrected audio signal obtained by correcting pitch to approximate the pitches of the number of pitch nodes to a predetermined reference value; and transforming, using the second time warping parameter, the pitch-corrected audio signal into an audio signal before correction by changing at least one pitch included in the pitches of the number of pitch nodes to restore the pitches of the number of pitch nodes to pitches before correction.

9. A non-transitory computer-readable recording medium on which a program is recorded which causes a computer to execute steps included in the coding method according to claim 7.

10. A non-transitory computer-readable recording medium on which a program is recorded which causes a computer to execute steps included in the decoding method according to claim 8.

11. An integrated circuit comprising:

a pitch contour detection unit configured to detect a pitch contour that is information indicating a change in pitch of an input audio signal within a period;

a dynamic time warping unit configured to: analyze the detected pitch contour; and determine, based on a result of the analysis, the number of pitch nodes that is an optimal number of pitches detected within the period; and generate a first time warping parameter including information indicating the determined number of pitch nodes, a pitch change position, and a pitch change ratio, the pitch change position being a position where the change in pitch occurs in pitches of the number of pitch nodes, the pitch change ratio being a ratio of the change in pitch at the pitch change position;

a first encoder which codes the generated first time warping parameter to generate a coded time warping parameter;

a time warping unit configured to correct, using the information obtained from the generated first time warping parameter, at least one pitch included in the pitches of the number of pitch nodes, to approximate the pitches of the number of pitch nodes to a predetermined reference value;

a second encoder which codes the input audio signal at the pitch corrected by the time warping unit to generate a coded audio signal; and a multiplexer which multiplexes the coded time warping parameter generated by the first encoder and the coded audio signal generated by the second encoder to generate a bitstream.

12. An integrated circuit comprising:

a demultiplexer which demultiplexes a coded audio signal and a coded time warping parameter from a bitstream, the coded audio signal being obtained by coding a pitch-corrected audio signal, the coded time warping parameter being obtained by coding a first time warping parameter for correcting pitches, the bitstream being obtained by multiplexing the coded audio signal and the coded time warping parameter;

a first decoding unit configured to decode the coded time warping parameter to generate a second time warping parameter including information indicating the number of pitch nodes, a pitch change position, and a pitch change ratio, the number of pitch nodes being the number of pitches detected within a period, the pitch change position being a position where a change in pitch occurs in pitches of the number of pitch nodes, the pitch change ratio being a ratio of the change at the pitch change position;

a second decoding unit configured to decode the coded audio signal to generate a pitch-corrected audio signal obtained by correcting pitch to approximate the pitches of the number of pitch nodes to a predetermined reference value; and a time warping unit configured to transform, using the second time warping parameter, the pitch-corrected audio signal into an audio signal before correction by changing at least one pitch included in the pitches of the number of pitch nodes to restore the pitches of the number of pitch nodes to pitches before correction.

* * * * *